US007097272B2

(12) United States Patent
Yoshida et al.

(10) Patent No.: US 7,097,272 B2
(45) Date of Patent: Aug. 29, 2006

(54) PRINTING APPARATUS, PRINT HEAD PERFORMANCE RECOVERY DEVICE AND METHOD, AND PISTON PUMP

(75) Inventors: Masahito Yoshida, Saitama (JP); Noboru Shimoyama, Kanagawa (JP); Yasuyuki Hirai, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 191 days.

(21) Appl. No.: 10/765,399

(22) Filed: Jan. 28, 2004

(65) Prior Publication Data

US 2004/0183852 A1 Sep. 23, 2004

(30) Foreign Application Priority Data

Jan. 31, 2003 (JP) ..... 2003-024917
Jan. 31, 2003 (JP) ..... 2003-024918

(51) Int. Cl.
*B41J 2/165* (2006.01)

(52) U.S. Cl. ..... 347/22; 347/23; 347/29; 347/30; 347/32; 347/33

(58) Field of Classification Search ..... 347/22–24, 347/29–33; 417/103, 374
See application file for complete search history.

(56) References Cited

U.S. PATENT DOCUMENTS 5,481,282 A * 1/1996 Iwata ..... 347/30
5,639,220 A * 6/1997 Hayakawa ..... 417/53
6,050,668 A * 4/2000 Ikado ..... 347/23
6,086,183 A * 7/2000 Nakahara ..... 347/30
6,312,093 B1 11/2001 Saijo et al. ..... 347/30
6,390,592 B1 5/2002 Okamura ..... 347/24
6,523,929 B1 2/2003 Kan et al. ..... 347/22
6,769,763 B1 * 8/2004 Kurata et al. ..... 347/85

FOREIGN PATENT DOCUMENTS

JP 11-138782 5/1999
JP 2000-135794 5/2000
JP 2001-58731 3/2001
JP 2001-58742 3/2001

* cited by examiner

*Primary Examiner*—Shih-Wen Hsieh
(74) *Attorney, Agent, or Firm*—Fitzpatrick, Cella, Harper & Scinto

(57) ABSTRACT

This invention provides a small and simple construction to drive a mechanism for maintaining a printing performance of a print head. In one preferred mode of the invention, a recovery device to maintain the printing performance of the print head has a suction pump unit, a capping unit and a wiping unit. The suction pump unit is driven through a spring clutch mechanism by an LF motor in the print sheet transport unit as a drive source. The capping unit and the wiping unit are driven by an AP motor as a drive source in a rotary dead zone set for a paper feed unit that feeds the print sheet to a transport unit. A piston pump is suited for use in a recovery operation to maintain the function of the print head.

27 Claims, 34 Drawing Sheets

PRINTING APPARATUS, PRINT HEAD PERFORMANCE RECOVERY DEVICE AND METHOD, AND PISTON PUMP

This application claims priority from Japanese Patent Application Nos. 2003-024917 filed Jan. 31, 2003 and 2003-024918 filed Jan. 31, 2003, which are incorporated herein by reference.

BACKGROUND OF THE INVENTION

1. Field of the Invention

The present invention relates to a printing apparatus that uses a print head to print an image including characters on a print medium such as printing sheet as it is transported, and more particularly to a printing apparatus in which a drive source for transporting the print medium is also used as a drive source for a print head performance recovery operation for maintaining the function of the print head.

The present invention also relates to a piston pump which drives a piston by a rotary drive force, and more particularly to a piston pump which is suitably applied to a recovery operation for maintaining the function of the print head in the printing apparatus demanded for size reduction and portability.

2. Description of the Related Art

As personal computers, word processors and facsimile machines have come into widespread use in offices in recent years, various kinds of printing apparatus are being offered as information output devices for these equipment. Among these output devices, printing apparatus such as ink jet printers (ink jet printing apparatus) that print images including characters by ejecting ink onto a print medium are well balanced in terms of image quality, print speed, apparatus size and price, and can easily be modified to produce color images. Because of these advantages, ink jet printers are in wide use in a variety of fields.

(Example Construction of Conventional Ink Jet Printer)

FIG. 40 is a perspective view showing a construction of a conventional ink jet printer.

A printing apparatus is generally made up of a combination of different mechanisms. In the ink jet printing apparatus of FIG. 40, a mechanism for feeding and transporting printing media has an automatic paper feed unit 100 for accommodating a plurality of print mediums such as print paper and for separating and feeding one sheet at a time, and a transport unit 200 situated downstream of the automatic paper feed unit 100 in the print medium feeding direction to transport the print medium in synchronism with an image printing. The automatic paper feed unit 100 has a paper feed roller placed in a pressure contact with the top of stacked print mediums and rotated to separate and feed an uppermost sheet. The transport unit 200 has an LF roller 201 driven by a drive source and a pinch roller 202 driven by the LF roller 201, with the print medium held between the pinch roller 202 and the LF roller 201.

A printing unit 400 has a carriage 401 that reciprocally moves along a guide member in a direction perpendicular to the print medium transport direction. The carriage 401 mounts an ink jet print head 500 that faces a print medium without contacting it. The ink jet print head 500 ejects ink from its nozzles according to image data.

A recovery unit 600 maintains a stable ink ejection performance of the ink jet print head 500 by removing viscous ink and dirt adhering to nozzle openings of the ink jet print head 500. The recovery unit 600 has a capping unit 601, a wiping mechanism and a suction mechanism to prevent drying and evaporation of ink from the nozzle openings of the ink jet print head 500. The capping unit 601 has a cap to cap a surface of the ink jet print head 500 formed with nozzle openings (referred to as a "nozzle face") when it is not printing. The wiping mechanism removes ink adhering to the nozzle face of the ink jet print head 500 as by a blade. The suction mechanism sucks out viscous ink from the nozzles of the ink jet print head 500 and nearby portions through the cap of the capping unit 601. The suction mechanism introduces a negative pressure from a pump into the cap engaging the nozzle face to draw out waste ink not contributing to the printing of images from the nozzles into the cap.

Such a conventional printing apparatus, as described in Patent References 1 and 2(listed below), is known to have a construction in which a plurality of drive mechanisms are driven by a second drive source separate from the drive source for the print head mounting carriage and in which a proper driving force from the second drive source is selected for output according to the position of the moving carriage. For example, in the case where a recovery mechanism and a sheet feeding mechanism are driven by the second drive source, the second drive source is selected for output to these mechanisms according to the position of the moving carriage or a registration operation during sheet feeding is activated or deactivated according to the position of the moving carriage. Patent Reference 3 discloses a construction in which the cap in the recovery unit is slid is to open and close the nozzle face according to the movement of the carriage.

Patent Reference 4 discloses a construction in which a third drive source, separate from the drive sources for the carriage and the print medium transport mechanism, activates the wiping operation, suction operation and paper feeding operation in the recovery unit. It is also described in Patent Reference 4 that the wiping operation and the suction operation in the recovery unit are selectively executed or one of a plurality of paper feeding mechanisms is selectively driven according to the position of the print head mounting carriage and the rotary direction and amount of rotation of the third drive source.

[Patent Reference 1]

Japanese Patent Application Laid-open No. 2001-058731

[Patent Reference 2]

Japanese Patent Application Laid-open No. 2001-058742

[Patent Reference 3]

Japanese Patent Application Laid-open No. 2000-135794

[Patent Reference 4]

Japanese Patent Application Laid-open No. 11-138782 (1999)

The constructions disclosed in Patent References 1–4, however, change an output destination of the driving force according to the operation of the carriage and therefore have the following problems.

The constructions disclosed in Patent References 1 and 2 require a relatively complex mechanism to switch the output destination of the driving force and take an additional time to move the carriage to the switching operation position and to execute the switching operation. In addition, the switching operation position needs to be provided outside the normal movement range of the carriage. This raises a problem of an increased apparatus body size in the carriage movement direction. These problems are also found with the construction shown in Patent Reference 3.

Further, the construction of Patent Reference 4 requires a complex mechanism for each of the wiping, suction and paper feeding operations to switch the output destination of the driving force of the third drive source. Furthermore, the problems still remain that the switching operation according to the position of the moving carriage takes an additional time and that the size reduction, simple construction and low cost are compromised.

(Example Construction of Pump in Conventional Printing Apparatus)

Printing apparatus with functions of printers, copying machines and facsimile machines, and printing apparatus used as output devices for composite electronic devices including computers and word processors and for workstations are constructed to form images on print mediums (recording medium) such as paper, thin plastic sheets, etc., according to image information. These printing apparatus may be classified into an ink jet system, a wire dot system, a thermal system and a laser beam system according to the printing method employed.

The printing apparatus may also be grouped into a serial type and a line type in terms of a printing action. In the serial type which employs a so-called serial scan method, a print head (printing means) is scanned in a main scan direction that crosses a sub scan direction in which a print medium is transported. In this type of printing apparatus, a print head is mounted on a carriage that moves along the print medium in the main scan direction, a print medium is set at a predetermined printing position, and then the print head is moved together with the carriage in the main scan direction to print one line of image. After one line of image is printed, the print medium is fed a predetermined distance in the sub scan direction and then the next line of image is printed on the print medium. This printing action and the paper feeding action are alternately repeated to print on an entire print area of the print medium.

In the line type, printing is done without moving the print head in the main scan direction. This type of printing apparatus uses an elongate print head that spans an entire width of the print area of the print medium. After the print medium is set at a predetermined printing position, an image is continuously printed by the print head as the print medium is fed in the sub scan direction.

Of these printing apparatus, an ink jet printing apparatus performs printing by ejecting ink from a printing means (print head) onto a print medium. The ink jet printing apparatus has many advantages, such as an ease with which the printing means can be reduced in size, an ability to print a high resolution image at high speed, an ability to print on plain paper without having to apply a special treatment to it, a low running cost, low noise realized by a non-impact printing, and an ease with which a color image can be printed using multiple color inks. In a line type ink jet printing apparatus which uses a full multi-type printing means (print head) having a large number of nozzles arrayed in a width direction of the print medium, a further increase in the printing speed can be achieved. Particularly, in an ink jet type printing means (print head) that uses thermal energy to elect ink, electrothermal transducers, electrodes, liquid path walls, a top wall, etc. are formed in a substrate through a semiconductor manufacturing process including etching, evaporation and sputtering to arrange ink ejection nozzles and liquid paths in high density. This in turn leads to a further reduction in the overall size of the printing means.

The ink jet printing apparatus generally performs a recovery operation to maintain or recover a stable ink ejection performance. The recovery operation includes a wiping operation for removing viscous ink and paper dust adhering to nozzle openings of the print head and nearby portions, a suction operation for sucking out viscous ink and bubbles from within the print head, and a preliminary ejection operation for ejecting viscous ink from those nozzles that were not activated during the printing operation. During the suction operation a large volume of ink not contributing to the image printing is drawn out by suction and discharged as waste ink. The suction operation uses a negative pressure to forcibly discharge ink from the nozzles. A recovery device for performing this suction operation includes a pump for generating a negative pressure. As the negative pressure generating pump, a so-called tube pump that squeezes a tube with a roller and a piston pump that drives a piston in a cylinder may be used.

FIG. 42 is a partly cutaway perspective view of a conventional tube pump installed in the recovery device of the printing apparatus.

A roller holder 1 rotates to cause rollers 2 rotatably mounted on the roller holder 1 to squeeze a tube 4 installed inside a tube guide 3 to generate a negative pressure in the tube 4. In the tube pump of a type that squeezes the tube 4 with the rollers 2, the tube 4 needs to be put in a cylindrical tube guide 3 about 20 mm in radius to prevent a possible buckling of the tube 4. This type of tube pump therefore is not suited for reducing an overall size of the recovery device. This tube pump, however, has an advantage of being able to easily change a suction volume and a suction speed. A piston pump on the other hand has an advantage that it is suited for a size reduction of the recovery device since the piston pump uses a cylinder only about 10 mm in inner diameter.

The piston pump generates or releases a negative pressure by a reciprocal motion of a piston shaft. Therefore, a drive mechanism for the piston pump conventionally incorporates a variety of conversion mechanisms for transforming a rotary motion of a motor as a drive source into a reciprocal motion.

FIG. 43 and FIG. 44 are perspective views showing different constructions, of a cam mechanism that reciprocally moves a piston 625 in a cylinder 624 of the piston pump.

In a cam mechanism of FIG. 43, a rotating shaft of a cam 5 and a piston shaft 626 cross each other at right angles, while a cam mechanism of FIG. 44 has the rotating shaft of the cam 5 and the piston shaft 626 arranged parallel to each other. The piston shaft 626 is allowed by the cylinder 624 to perform only a reciprocal motion. As the cam 5 continues to rotate in one direction, a driving force is transmitted from the cam 5 through a projection 6 to the piston shaft 626, which repetitively performs a reciprocal motion. The cam mechanisms of FIG. 43 and FIG. 44 both have a simple driving method though the cam portion tends to be larger than the pump portion.

FIG. 45 is a partial cross section showing a construction different from those of FIG. 43 and FIG. 44, as a mechanism for reciprocally driving the piston 625 in the cylinder 624 of the piston pump.

In FIG. 45, the piston shaft 626, which is reciprocally movable in the direction of arrows A1, B1, is made unrotatable about its axis. The piston shaft 626 has a screw groove 7 and a screw cam 8 has protrusions that engage the screw groove 7, so that the piston shaft 626 reciprocates according to the rotating direction of the cam 8. That is, as the cam 8 rotates in one direction, the piston shaft 626 moves in the direction of arrow A1. When the cam 8 rotates in the opposite direction, the piston shaft 626 moves in the direction of arrow B1. The use of such a screw mechanism allows for a size reduction of the cam 8. However, to reciprocate the piston shaft 626 requires repetitive rotation of the cam 8 and It is also necessary to control the amount of rotation, making this driving method complex.

In recent years there are growing demands on the ink jet printing apparatus for a smaller size and an improved portability. To meet these demands, it is necessary keep the height (thickness) of the printing apparatus body low. Therefore, the usefulness of the piston pump that can be reduced in size increases. It is also necessary to simplify the construction of the drive mechanism while realizing a greater size reduction than is possible with the conventional apparatus.

SUMMARY OF THE INVENTION

An object of the present invention is to provide a printing apparatus, a print head recovery device and a print head recovery method, by which a mechanism to maintain a printing performance of the print head is driven by a small and simple construction.

Another object of the present invention is to provide a piston pump of simple construction that can be suitably used in a recovery operation for maintaining the function of the print head in a printing apparatus that aims to meet demands for smaller size and improved portability. It is still another object of this invention to provide a printing apparatus and a recovery device incorporating such a piston pump.

In the first aspect of the present invention, there is provided a printing apparatus for printing an image on a print medium by using a print head, comprising:

a transport means for transporting the print medium by a driving force of a first drive source;

a feeding means for feeding the print medium to the transport means by a driving force of a second drive source; and a recovery means for performing, by a first drive mechanism and a second drive mechanism, a recovery operation to maintain a printing performance of the print head;

wherein the first drive mechanism uses the first drive source as its drive source and is operated through a clutch mechanism according to a direction in which a driving force of the first drive source is generated, the clutch mechanism being adapted to transmit a rotation in only one direction of the first drive source;

wherein the second drive mechanism uses the second drive source as its drive source, has a dead zone in which a rotational force is not transmitted to the feeding means when the second drive source changes its rotation direction, and is operated in the dead zone according to a direction in which a driving force of the second drive source is generated.

In the second aspect of the present invention, there is provided a recovery device for performing a recovery operation on a print head to maintain a printing performance of the print head, the print head being adapted to print an image on a print medium, the recovery device comprising:

a first drive mechanism and a second drive mechanism for performing the recovery operation;

wherein the first drive mechanism uses as its drive source a first drive source for driving a transport means to transport the print medium and is operated through a clutch mechanism according to a direction in which a driving force of the first drive source is generated, the clutch mechanism being adapted to transmit a rotation in only one direction of the first drive source;

wherein the second drive mechanism uses as its drive source a second drive source for driving a feeding means to feed the print medium to the transport means, has a dead zone in which a rotational force is not transmitted to the feeding means when the second drive source changes its rotation direction, and is operated in the dead zone according to a direction in which a driving force of the second drive source is generated.

In the third aspect of the present invention there is provided a recovery method for performing a recovery operation on a print head to maintain a printing performance of the print head, the print head being adapted to print an image on a print medium, the recovery method comprising the steps of:

using a first drive mechanism and a second drive mechanism for performing the recovery operation;

wherein the first drive mechanism uses as its drive source a first drive source for driving a transport means to transport the print medium and is operated through a clutch mechanism according to a direction in which a driving force of the first drive source is generated, the clutch mechanism being adapted to transmit a rotation in only one direction of the first drive source;

wherein the second drive mechanism uses as its drive source a second drive source for driving a feeding means to feed the print medium to the transport means, has a dead zone in which a rotational force is not transmitted to the feeding means when the second drive source changes its rotation direction, and is operated in the dead zone according to a direction in which a driving force of the second drive source is generated.

In the fourth aspect of the present invention, there is provided a piston pump for reciprocally driving a piston in a cylinder through a piston shaft by using a rotating force of a rotating body, wherein the piston shaft is kept from rotating about its own axis, wherein the rotating body is rotatable about the axis of the piston shaft, wherein one of facing parts of a circumference of the piston shaft and a circumference of the rotating body is formed with a continuous spiral groove that crosses at one part, wherein the other of the facing parts is provided with a projection that fits in the groove so that it is movable relative to the groove, in order to convert a rotary motion in at least one direction of the rotating body into a linear reciprocal motion of the piston shaft.

In the fifth aspect of the present invention, there is provided a printing apparatus for printing an image on a print medium by using a print head, comprising:

a recovery means for performing a recovery operation to maintain a function of the print head by using an introduced pressure;

wherein the piston pump as defined in the fourth aspect of the present invention is used as a source of the pressure used by the recovery means.

In the sixth aspect of the present invention, there is provided a recovery device for performing a recovery operation to maintain a function of a print head by using an introduced pressure, the recovery device having the piston pump as defined in the fourth aspect of the present invention as a source of the pressure used by the recovery operation.

With this invention, a first drive mechanism and a second drive mechanism are used to perform a recovery operation for maintaining the printing performance of the print head. The first drive mechanism uses as its drive source a first drive source for driving a transport means to transport the print medium and operates through a clutch mechanism according to a driving force generating direction of the first drive source, the clutch mechanism being adapted to transmit a rotation in only one direction of the first drive source. The second drive mechanism uses as its drive source a second drive source for driving a feeding means to feed the print medium to the transport means, has a dead zone in which a rotational force is not transmitted to the feeding means when the second drive source changes its rotation direction, and operates in the dead zone according to a driving force generating direction of the second drive source. This arrangement makes it possible to control the first drive mechanism and the second drive mechanism with ease by simply switching the driving force generating direction of the first drive source and the second drive source.

This in turn eliminates the need for a complex drive transmission switching mechanism which would be required in performing the recovery operation, resulting in a smaller size, simpler construction and lower cost of the apparatus.

With this invention, a mechanism for converting a rotary motion of the rotating body into a linear motion of the piston shaft can be constructed easily by fitting a projection of the rotating body into a continuous spiral groove formed in the piston shaft. As a result, particularly in those printing apparatus required to meet higher standards of compactness and portability, it is possible to construct a piston pump suited for use in the recovery operation for maintaining the print head performance.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of the present invention will be described by referring to the accompanying drawings.

Figure 1:
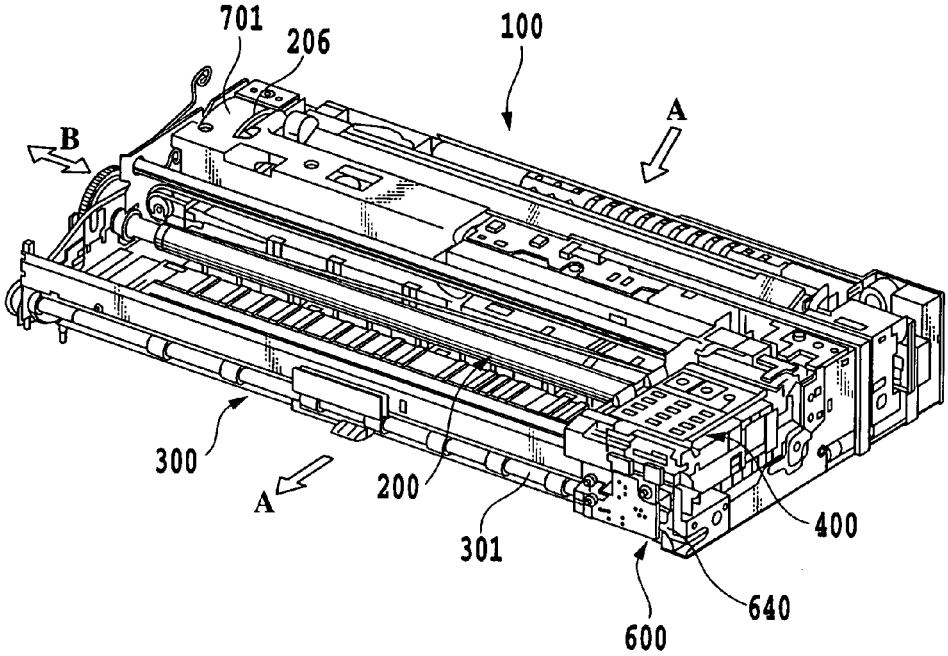
FIG. 1 is a perspective view showing a printing operation mechanism excluding an enclosure in the printing apparatus of this invention.

FIG. 1 is a perspective view showing an entire printing apparatus of this embodiment excluding an enclosure. A printing operation mechanism in this embodiment of the printing apparatus largely comprises an automatic paper feed unit 100, a transport unit 200, a discharge unit 300, a printing unit 400, and a recovery unit 600. The automatic paper feed unit 100 automatically feeds print sheets as print mediums to the transport unit 200 in the printing apparatus body. The transport unit 200 introduces sheets, one at a time, from the automatic paper feed unit 100 to a desired printing position and also discharges printed sheets from the printing position. The discharge unit 300 is situated downstream of the transport unit 200 in the transport direction. The printing unit 400 performs a desired printing on the sheet transported by the transport unit 200. The recovery unit 600 performs a recovery operation on the printing unit 400. These units are constructed almost integrally on a chassis 701. A print sheet transport direction (sub scan direction) is indicated by an arrow A and a direction in which the printing unit 400 is reciprocated (main scan direction) is indicated by an arrow B.

Next, individual units making up the printing operation mechanism will be explained as follows.

(Automatic Paper Feed Unit 100)

Figure 2:
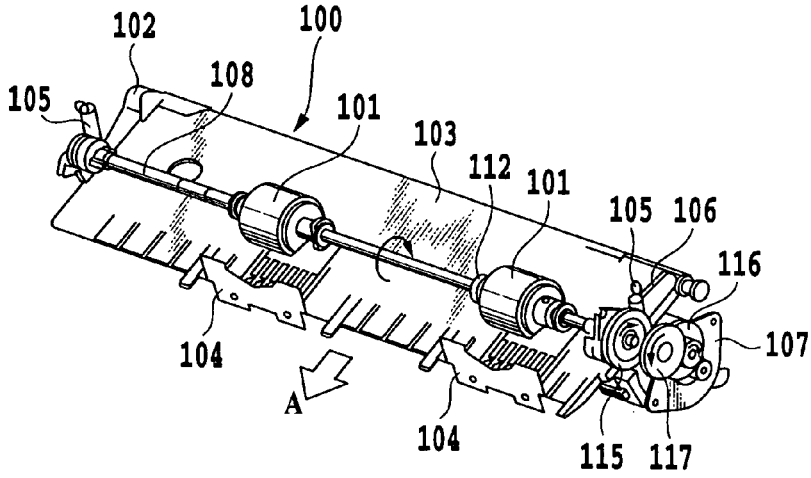
FIG. 2 is a perspective view showing only parts of an automatic paper feed unit in the printing apparatus of FIG. 1.

FIG. 2 is a perspective view showing only constitutional parts of the automatic paper feed unit 100.

The automatic paper feed unit 100 of this embodiment horizontally feeds print sheets stacked at an angle of about 30–60 degrees to a horizontal plane. While keeping the print sheet in the almost horizontal attitude, the automatic paper feed unit 100 feeds it from the supply port (not shown) to the transport unit 200.

The automatic paper feed unit 100 includes paper feed rollers 101, a movable side guide 102, a pressure plate 103 and separation seats 104. The pressure plate 103 supporting the print sheets is attached to the chassis 701 (see FIG. 1) so that it has an angle of about 30–60 degrees to a horizontal plane. At both ends of the pressure plate 103 a sheet guide 106 and the movable side guide 102 are arranged, both protruding to guide side edges of the print sheets. The movable side guide 102 is horizontally movable along the pressure plate 103 so that it matches the horizontal size (width) of the print sheet.

In front of the pressure plate 103 a paper feed roller shaft 108 is rotatably supported and is rotated by an AP motor 107 through a plurality of transmission gears, i.e., an AP gear a 116, an AP gear b 117 and a paper feed roller gear 115. The paper feed roller shaft 108 is securely attached with two paper feed rollers 101 D-shaped in cross-section. As the paper feed rollers 101 are rotated by the AP motor 107, the print sheets stacked on the pressure plate 103 are fed one sheet at a time, beginning with the uppermost sheet. That is, the uppermost sheet of the stacked print sheets is separated one by one by a frictional separation action produced when the sheet rides over the separation seats 104, and then fed in the direction of arrow A to the transport unit 200. The pressure plate 103 is elastically supported on the chassis 701 by two pressure plate springs 105 at both ends of the pressure plate 103 which are interposed between the pressure plate 103 and the chassis 701 (see FIG. 1). The contact pressure between the paper feed rollers 101 and the print sheet is kept at an optimum value for an allowable range of stacked sheets.

Figure 3:
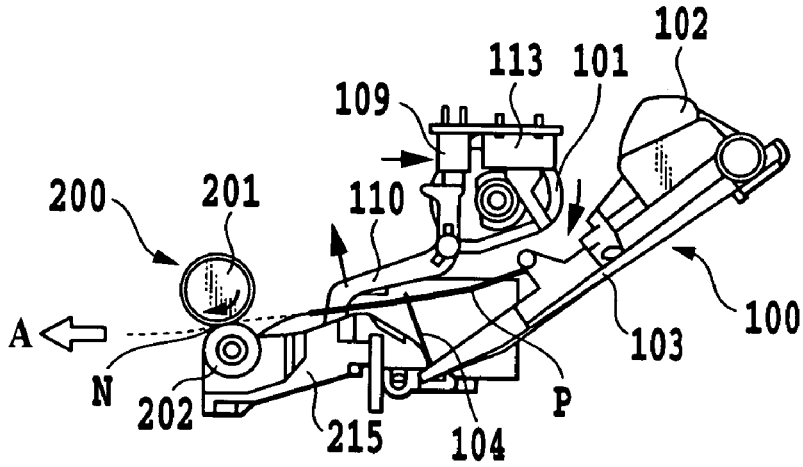
FIG. 3 is a side view showing only parts of the automatic paper feed unit and a transport unit in the printing apparatus of FIG. 1.
Figure 4:
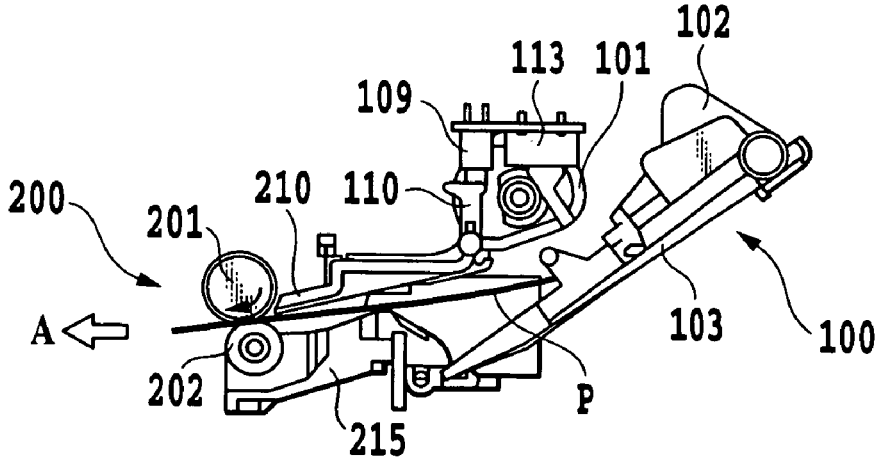
FIG. 4 is a side view showing only parts of the automatic paper feed unit and the transport unit in the printing apparatus of FIG. 1.

FIG. 3 and FIG. 4 are side views showing only parts of the automatic paper feed unit 100 and the transport unit 200.

In a transport path of the print sheet P ranging from the automatic paper feed unit 100 to the transport unit 200, a PE lever 110 extending from a PE sensor switch 109 is arranged. The print sheet P, separated and transported one by one from the automatic paper feed unit 100, passes through a path between an upper transport guide 210 and a lower transport guide 215. When one end of the print sheet P activates the PE lever 110, the PE sensor switch is 109 detects an operation of the PE lever 110 and decides that the print sheet P has entered into the transport path. After the entry of the print sheet P into the transport path has been detected, the print sheet P is fed a predetermined distance downstream in the transport direction by the paper feed rollers 101. This paper feed operation by the paper feed rollers 101 is performed reliably until a front end of the print sheet P engages a nip portion N formed between an LF roller 201 and pinch rollers 202, both at rest, in the transport unit 200 so that it can be transported by the transport unit 200.

Figure 5:
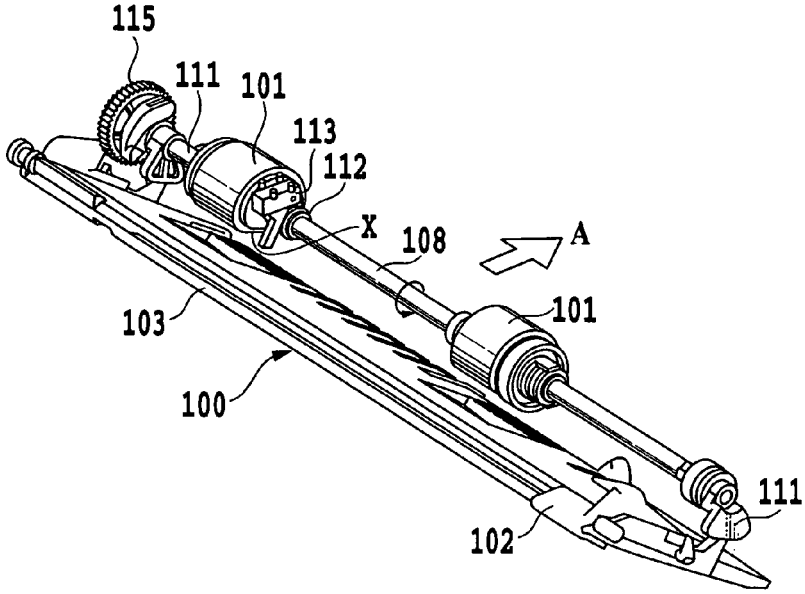
FIG. 5 is a perspective view showing only parts of the automatic paper feed unit in the printing apparatus of FIG. 1.

FIG. 5 is a perspective view showing only parts of the automatic paper feed unit 100.

After the paper feed operation by the automatic paper feed unit 100 is completed, planar portions X of the paper feed rollers 101 D-shaped in cross-section are almost parallel to the pressure plate 103 and the pressure plate 103 is parted from the paper feed rollers 101 by two pressure plate cams 111 provided on the paper feed roller shaft 108. An ASF sensor cam 112 is provided on the paper feed roller shaft 108. The orientation of the planar portions X in the paper feed rollers 101 D-shaped in cross-section can be controlled by an ASF sensor switch 113 detecting a phase of the ASP sensor cam 112.

(Transport Unit 200)

Figure 6:
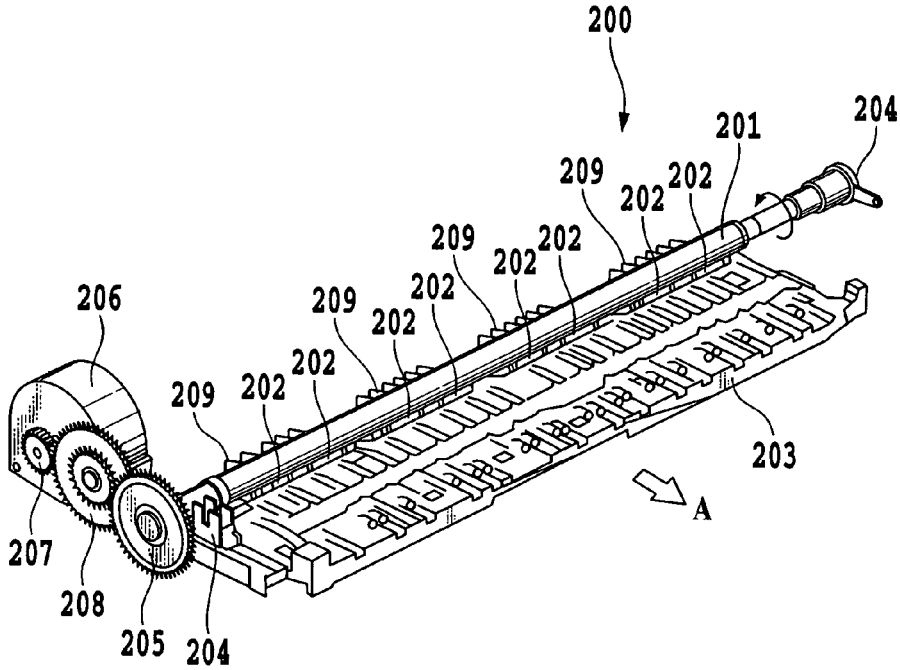
FIG. 6 is a perspective view showing only parts of the transport unit in the printing apparatus of FIG. 1.
Figure 7:
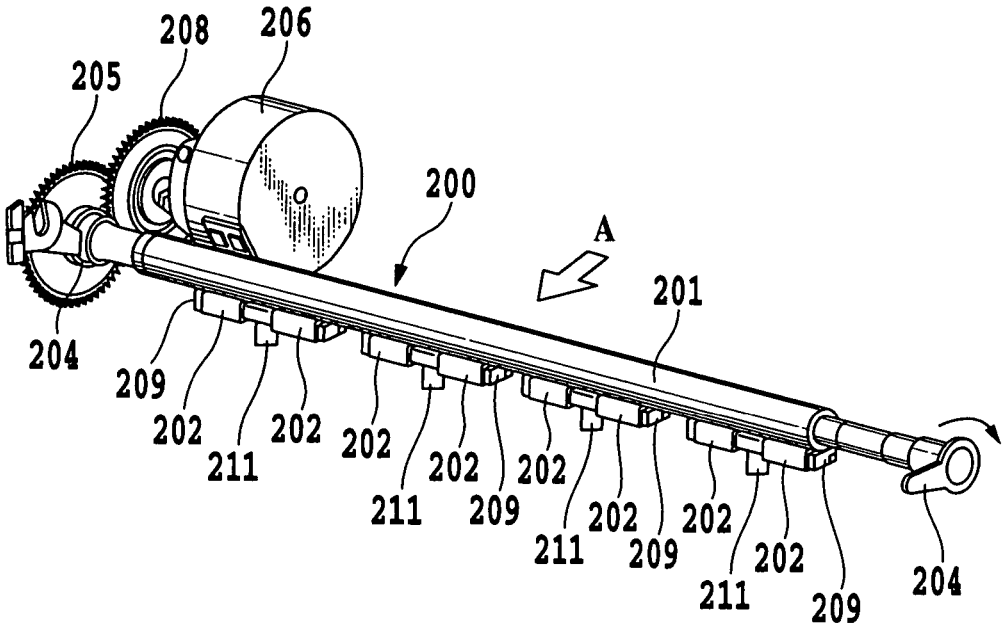
FIG. 7 is a perspective view showing only parts of the transport unit in the printing apparatus of FIG. 1.

FIG. 6 and FIG. 7 are perspective views showing only parts of the transport unit 200.

The transport unit 200 has the LF roller 201, pinch rollers 202 and a platen 203. The LF roller 201 is rotatably supported on the chassis 701 through LF bearings 204 (see FIG. 1) and has an LF gear 205 at one end. The LF gear 205 is driven by a LF drive gear 207 mounted on a drive shaft of a LF motor 206 through a LF double gear 208. The pinch rollers 202 are rotatably mounted on pinch roller holders 209. The pinch roller holders 209 extend upward from the upper transport guide 210 (FIG. 4) fixed to a planar portion of the chassis 701 (FIG. 1). The pinch rollers 202 are pressed against the LF roller 201 by a bias force of pinch roller springs 211. As the LF roller 201 rotates driving the pinch rollers 202 to rotate, the print sheet fed from the automatic paper feed unit 100 is held between the rollers 201, 202 and transported along an upper surface of the platen 203.

After the front end of the print sheet P, fed by the paper feed rollers 101 of the automatic paper feed unit 100, has reached the nip portion N between the LF roller 201 and the pinch rollers 202 the LF roller 201 is driven by the LF motor 206 through the LF double gear 208 and the LF gear 205. As a result, the print sheet P is transported to a print start position on the platen 203. The print start position varies depending on the content to be printed.

The paper feed rollers 101 may rotate simultaneously with the LF roller 201 for a margin of the feed distance. In that case the print sheet P is fed downstream in the transport direction by the coordinated action of the paper feed rollers 101 and the LF roller 201 for a predetermined duration. Then, after the rotation of the paper feed rollers 101 is completed, the LF roller 201 is rotated forward or backward as necessary to feed the print sheet P to the print start position. The printing unit 400 (described later) now prints a first part of an image, after which the LF roller 201 is rotated to feed the print sheet P a predetermined distance. The printing unit 400 again prints a subsequent part of the image. By alternating these operations—printing an image and feeding the print sheet a predetermined distance—an image is formed on the print sheet P supported on the platen 203.

(Discharge Unit 300)

Figure 8:
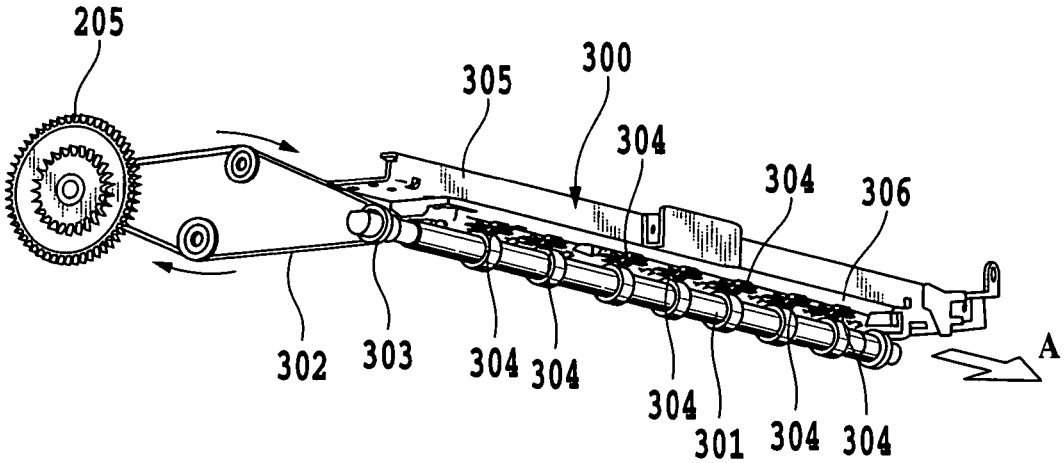
FIG. 8 is a perspective view showing only parts of a discharge unit and the transport unit in the printing apparatus of FIG. 1.
Figure 9:
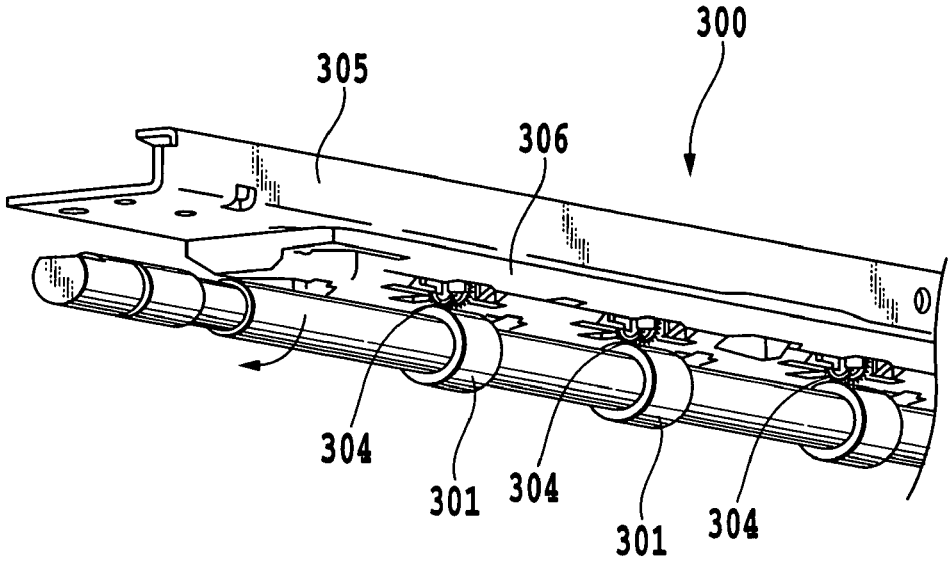
FIG. 9 is a perspective view showing only parts of the discharge unit and the transport unit in the printing apparatus of FIG. 1.
Figure 10:
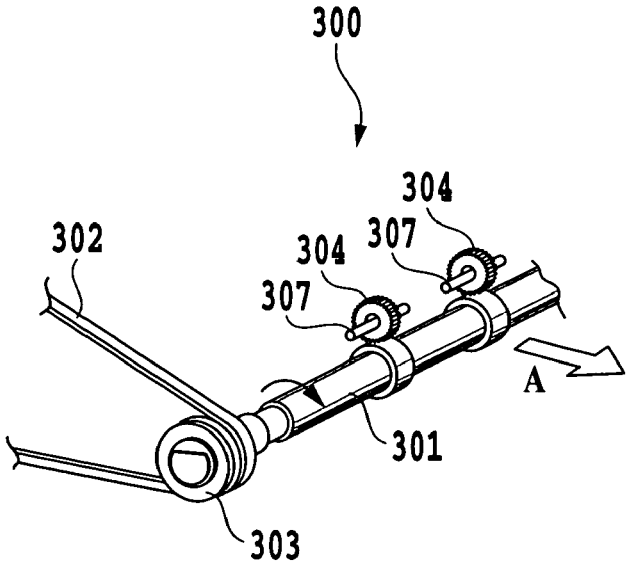
FIG. 10 is a perspective view showing only parts of the discharge unit and the transport unit in the printing apparatus of FIG. 1.

FIGS. 8 to 10 are perspective views showing parts of the discharge unit 300 and the transport unit 200.

The discharge unit 300 has a discharge roller 301 and spurs 304. A discharge pulley 303 mounted on the discharge roller 301 transfers a driving force of the LF motor 206 to the discharge roller 301 through a discharge belt 302. The spurs 304 are supported in a spur holder 306 mounted to a guide rail 305. The spurs 304 are pressed against the discharge roller 301 by a bias force of spur springs 307 and are driven by the rotating discharge roller 301 to transport the print sheet P while holding it between the spurs 304 and the discharge roller 301.

Figure 11:
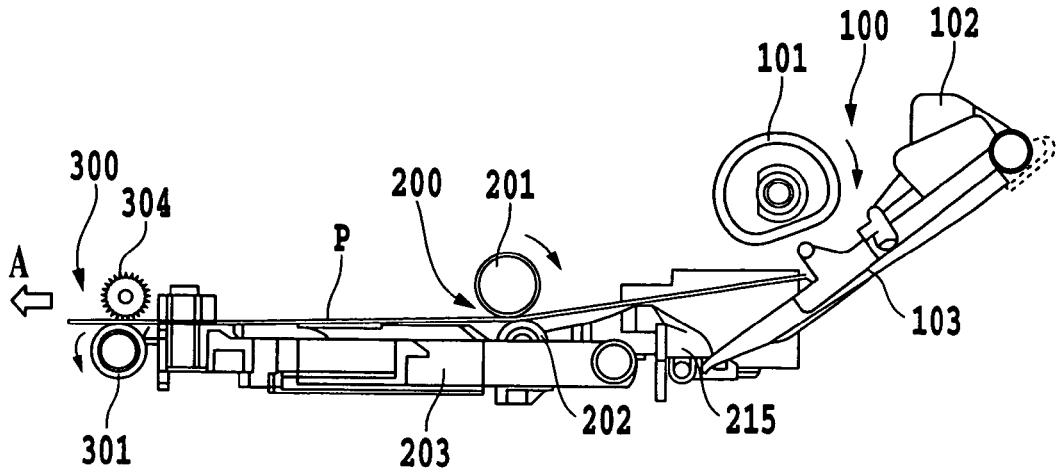
FIG. 11 is a side view showing only parts of the automatic paper feed unit, the transport unit and the discharge unit in the printing apparatus of FIG. 1.

FIG. 11 is a side view showing parts of the automatic paper feed unit 100, transport unit 200 and discharge unit 300.

The print sheet P is printed as it is transported from the automatic paper feed unit 100 to the transport unit 200 and to the discharge unit 300. When the printing on the print sheet P is completed, the rear end of the print sheet P comes out from between the LF roller 201 and the pinch rollers 202. Then, the print sheet P is transported only by the discharge roller 301 and the spurs 304 to be discharged from the apparatus body.

(Printing Unit 400)

Figure 12:
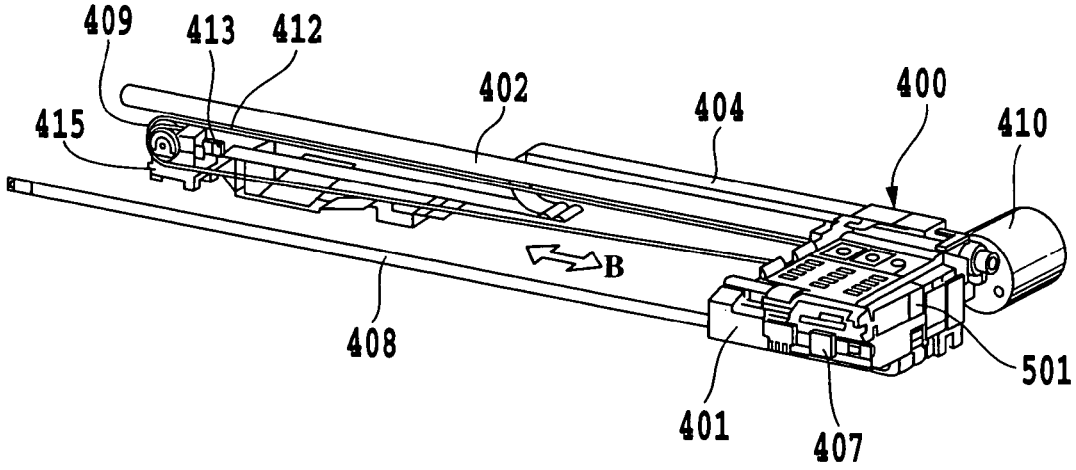
FIG. 12 is a perspective view showing only parts of the printing unit in the printing apparatus of FIG. 1.

FIG. 12 is a perspective view showing only parts of the printing unit 400.

The printing unit 400 has a carriage 401 movably supported on a carriage shaft 402. The carriage 401 removably mounts a print head cartridge 501. The print head cartridge 501 in this embodiment includes an ink jet print head capable of ejecting ink from its nozzles according to print information and an ink tank containing ink to be supplied to the print head. The ink tank is removably attached to the print head.

The ink jet print head may employ a print head that ejects ink from its nozzles by using electrothermal transducers (heaters) or piezoelectric elements. When the electrothermal transducers are used, the electrothermal transducers heat and boil ink and, by energy of expanding bubbles, eject drops of ink from the nozzles.

The carriage 401 has a head connector (not shown) which is electrically connected to a carriage FPC (flexible printed circuit board) 404. The head connector, when connected with external input signal terminals provided in the print head cartridge 501, sends and receives a variety of information for printing and also supplies electric power to the print head. The carriage FPC 404 is drawn out of the carriage 401 for electrical connection with a main printed circuit board (not shown) in the apparatus body. The carriage FPC 404 on the carriage 401 also has an encoder sensor 407.

Figure 13:
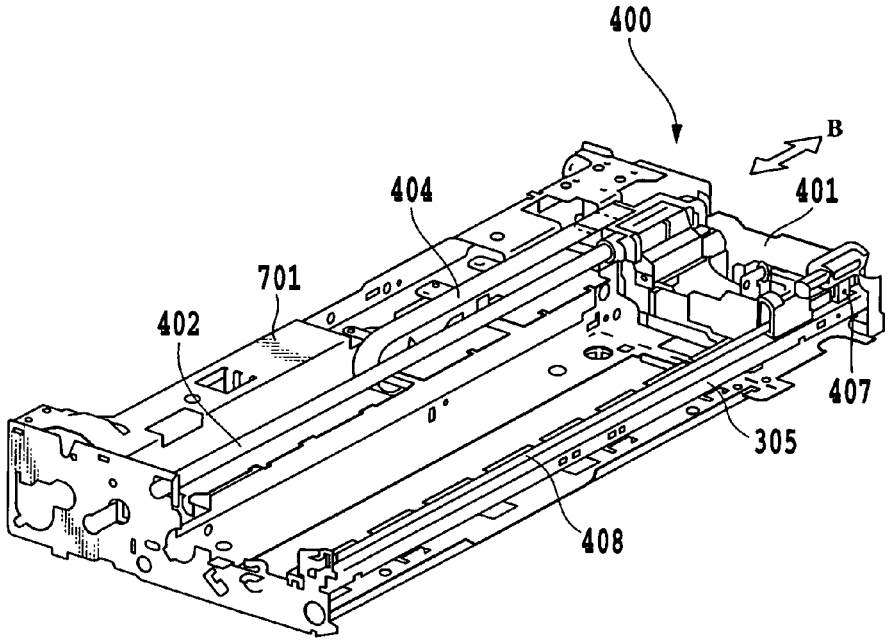
FIG. 13 is a perspective view showing parts of a carriage and its scan unit of FIG. 12.

FIG. 13 is a perspective view showing parts of the carriage 401 and a scan unit for scanning the carriage 401.

Between side edges of the chassis 701, an encoder scale 408 extends parallel to the guide shaft 402. Information on the encoder scale 408 is read by the encoder sensor 407 on the carriage 401 to detect a position and a scan speed of the carriage 401. In this embodiment, the encoder sensor 407 is an optical transmission type sensor and the encoder scale 408 is formed by printing light shielding portions and light transmitting portions alternately at a predetermined pitch. That is, the encoder scale 408 is a resin film such as polyester film which is printed, as by photographic printing, with light shielding portions, that shields detection light from the encoder sensor 407, and light transmitting portions, that passes the detection light, alternately at a predetermined pitch.

The position of the carriage 401 that moves along the guide shaft 402 is detected by taking as a reference a position where the carriage 401 abuts against one side plate of the chassis 701 situated at one end of a stroke of the carriage 401. That is, after the carriage 401 is engaged with one side plate of the chassis 701, the position of the moving carriage 401 is detected by detecting a pattern of the encoder scale 408 (a pattern of light shielding portion and light transmitting portion) by the encoder sensor 407 and counting the number of pattern detections.

Between the side surfaces of the chassis 701, the guide shaft 402 and the guide rail 305 are arranged parallel to each other. The carriage 401 is movably guided along the guide shaft 402 and a rail portion provided on the guide rail 305. As a result, the carriage 401 is supported movably in the main scan direction which is perpendicular to the transport direction of a print medium (which includes a flexible printable sheet, such as a plastic sheet) and parallel to a print surface of the print medium.

Figure 14:
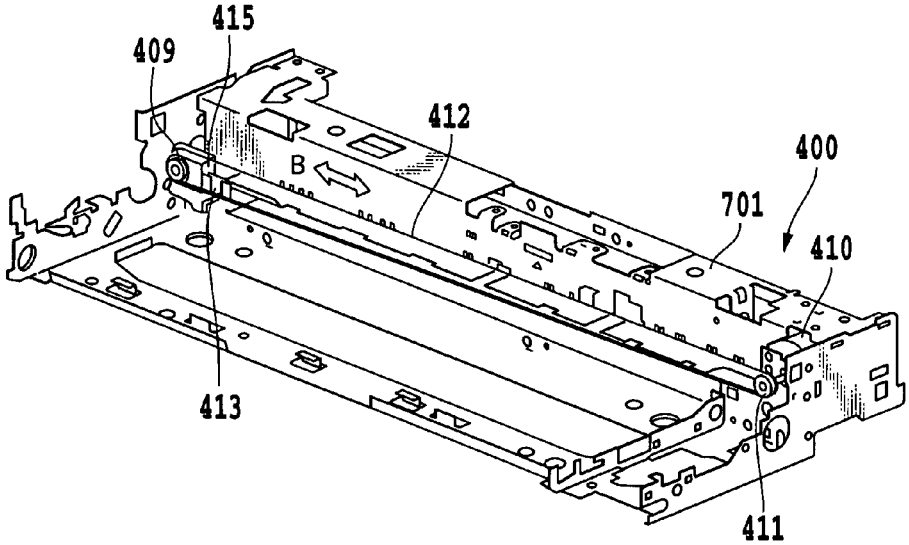
FIG. 14 is a perspective view showing parts of a drive unit of the carriage of FIG. 13.

FIG. 14 is a perspective view showing parts of a drive unit for the carriage 401.

Between an idler pulley 409 and a CR motor pulley 411, a carriage belt 412 extends almost parallel to the guide shaft 402 and is connected to the carriage 401. Hence, a CR motor 410 drives the CR motor pulley 411 causing the carriage belt 412 to move in the forward or backward direction to reciprocally move the carriage 401 along the guide shaft 402. The CR motor pulley 411 is rotatably held at a predetermined position on the chassis 701. The idler pulley 409 is rotatably held in a pulley holder 415, which is mounted on the chassis 701 so that it is slidable in a direction parallel to the guide shaft 402. The idler pulley 409 is biased away from the CR motor pulley 411 by a tension spring 413. The carriage belt 412 extending between these pulleys 409, 411 is given an appropriate tension at all times to maintain a good tightened state.

(Recovery Unit 600)

Figure 15:
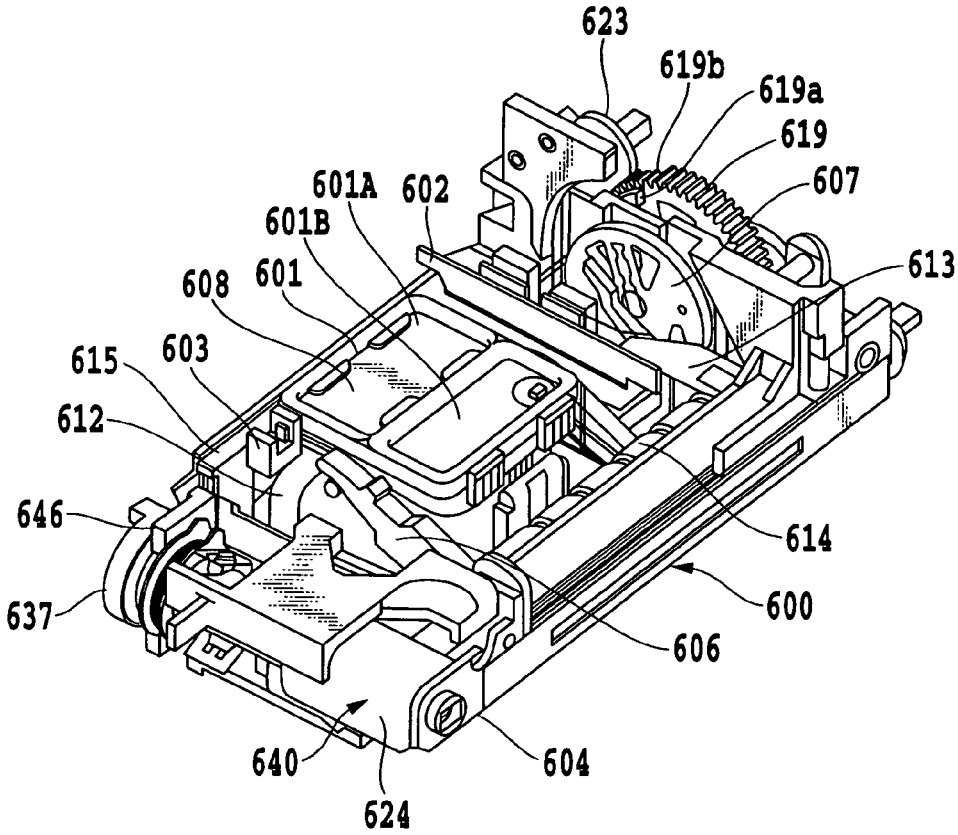
FIG. 15 is a perspective view showing an entire recovery unit in the printing apparatus of FIG. 1.

FIG. 15 is an overall perspective view of the recovery unit 600 that performs a recovery operation on the print head cartridge 501.

The recovery unit 600 of this embodiment has a cleaning means and a recovery means. The cleaning means removes foreign materials adhering to the nozzle face of the print head of the print head cartridge 501. The recovery means removes foreign materials and trapped air from an ink path extending from the ink tank to the nozzle face of the print head to recover a normal condition of the ink path. The recovery unit 600 comprises largely a capping unit, a wiper unit and a suction pump unit. A drive source to drive the capping unit and the wiper unit uses the AP motor 107 (FIG. 27), which is also a drive source of the automatic paper feed unit 100. A drive source for driving the suction pump unit uses the LF motor 206 (FIG. 6), which is also a drive source of the transport unit 200.

Figure 16:
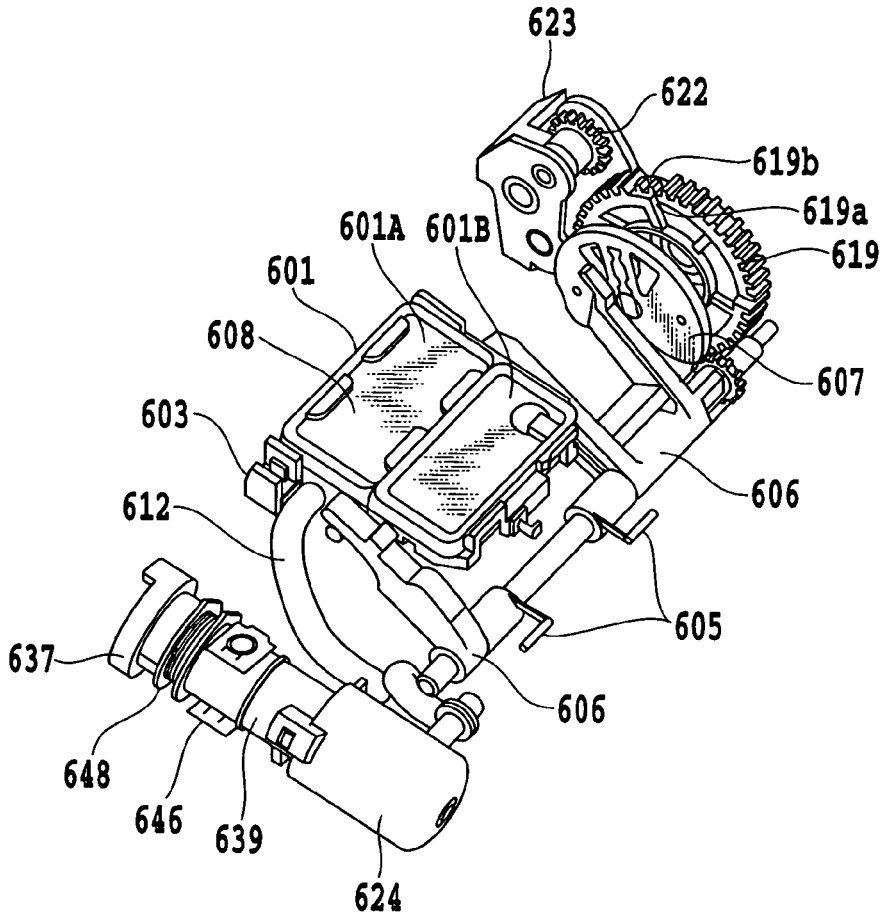
FIG. 16 is a perspective view showing a capping unit and its operation mechanism of FIG. 15.

FIG. 16 is a perspective view of the capping unit and its operating mechanism.

The cap 601 is made of a rubber material and attached to a surface of a rigid cap holder 603. The cap holder 603 is mounted on a PG base 604 so that it is vertically movable along a guide groove in an attitude parallel to the base. The cap holder 603 is urged upward, i.e., toward the ink jet print head 500, from the PG base 604 by a cap spring 605. The cap holder 603 is lowered by a cap lever 606. The cap lever 606 is rotatably mounted on the PG base 604 so that it is pivotable about the shaft, with one end of the cap lever 606 moving to follow the curved surface of a rotating cap cam 607. Therefore, the vertical position of the cap 601 is determined by the rotary position of the cap cam 607 through the cap lever 606.

The cap 601 in the capping unit comprises a suction cap 601A and a protective cap 601B integrally combined together. When the nozzle face of the print head is to be protected as when the printing apparatus is turned off, the suction cap 601A caps color ink nozzles (or simply referred to as "color nozzles") and the protective cap 601B caps black in knozzles (or simply referred to as "Bk nozzles") A cap absorber 608 provided in the suction cap 601A opposes the nozzle face of the print head with a predetermined clearance therebetween when the suction cap 601A caps the nozzle face. The suction cap 601A can perform a recovery operation (sucking recovery operation) while it is capping the color nozzles, by introducing a negative pressure to draw out and discharge ink not contributing to the image printing from the color nozzles. When the sucking recovery operation is to be performed on the Bk nozzles, the carriage 401 is stopped at a different position so that the Bk nozzles can be capped with the suction cap 601A.

Figure 17:
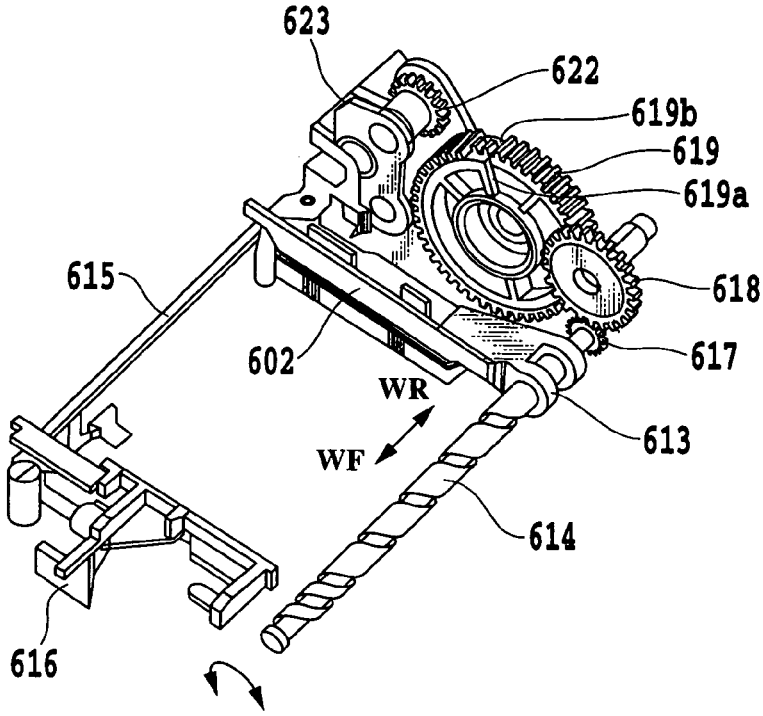
FIG. 17 is a perspective view showing a wiper unit and its operation mechanism of FIG. 15.

FIG. 17 is a perspective view of the wiping unit and its operation mechanism.

A wiper 602 in the wiping unit is made of an elastic member such as rubber and is erected on a blade holder 613 so that its edge portion protrudes upward. The blade holder 613 has one of its ends sleeved over a wiper lead screw 614 and the other end guided by a blade rail 615 arranged parallel to the nozzle face of the print head. A groove formed in the wiper lead screw 614 is engaged by protrusions of the blade holder 613. Therefore, the blade holder 613 parallelly moves along the wiper lead screw 614 and the blade rail 615 in a WF or WR direction according to the rotating direction of the wiper lead screw 614.

The wiper lead screw 614 has a blade screw gear 617 mounted at one end thereof, which is driven by a cap cam gear 619 through a blade idler gear 618. The cap cam gear 619 is mounted on the PG base 604 so that it is rotated together with the cap cam 607 (FIG. 16). A gear unit that transmits a driving force from the cap cam gear 619 to the wiper 602 limits an operation range of the wiper 602 by a notched portion 619*a* formed at a position corresponding to the operation of the cap cam 607. The wiper 602 engages a wiper cleaner 616 when it moves to an extreme position in the WF direction.

Figure 18:
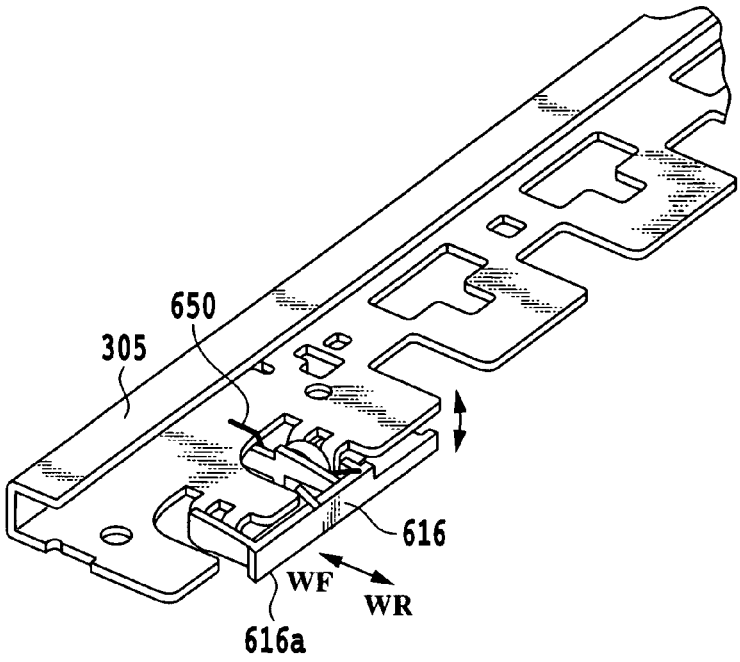
FIG. 18 is a perspective view showing a wiper cleaner portion mounted to a guide rail of FIG. 13.

FIG. 18 is a perspective view of a wiper cleaner 616 attached to the guide rail 305.

The wiper cleaner 616 is pivotally mounted to the guide rail 305 and is urged downward by a wiper cleaner spring 650. A spring force of the wiper cleaner spring 650 is set very weak. The wiper cleaner 616 is arranged parallel to a wiping ridge of the wiper 602 and forms a rib that is supported tiltable in only one pivoting direction by the wiper cleaner spring 650.

Figure 19:
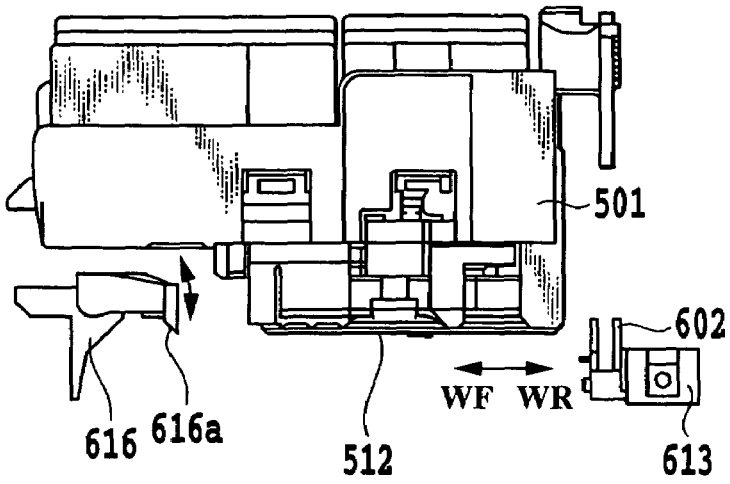
FIG. 19 is a side view showing the wiper unit and a print head cartridge of FIG. 15.

FIG. 19 is a side view of the wiping unit and the print head cartridge 501.

The wiper 602 is moved parallel to the nozzle face 512 of the print head in the print head cartridge 501 to wipe foreign materials off the nozzle face 512.

In this embodiment, when the wiper 602 moves in the WF direction (from the back toward the front), it performs a cleaning action. After wiping the nozzle face 512 of the print head cartridge 501 and leaving the nozzle face 512, the wiper 602 reaches a position of the wiper cleaner 616. After the wiper 602 has moved from the rear toward the front to wipe the nozzle face 512, the free end of the wiper 602 rides over rib ridge 616*a* of the wiper cleaner 616, at which time the wiper 602 is cleared of ink and foreign materials adhering to the wiper 602. When the wiper 602 moves in the WR direction (from the front toward the rear), the rib ridge 616*a* of the wiper cleaner 616 is pushed up by the wiper 602, allowing the wiper 602 to move back with a small load without being deflected. This prevents backward spraying of unwanted ink from the wiper 602.

Figure 20:
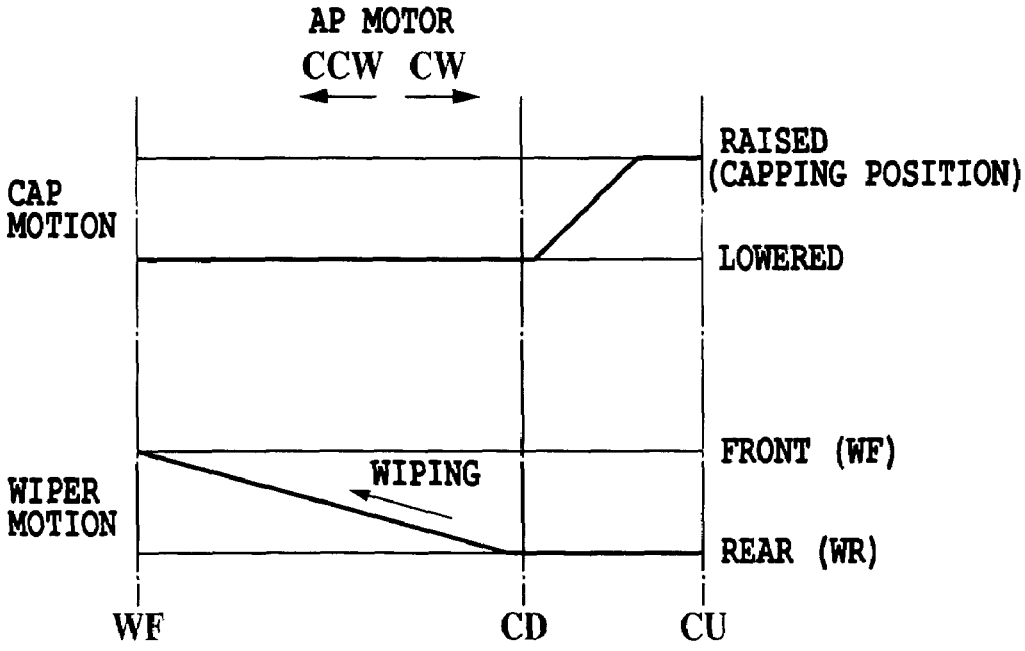
FIG. 20 is a cam chart showing operations of a wiper and a cap of FIG. 15.
Figure 21:
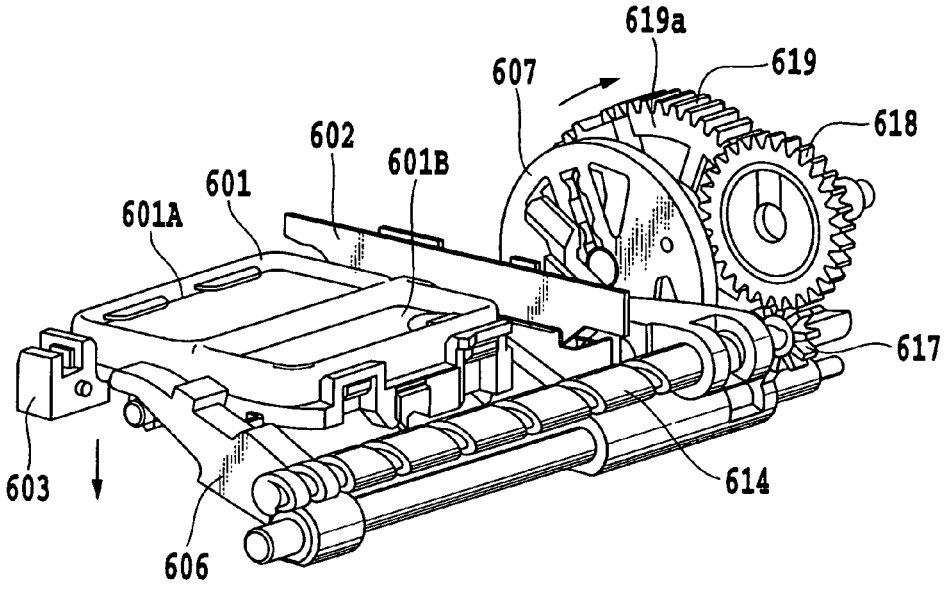
FIG. 21 is a perspective view showing the wiper and the cap at a position CU in the cam chart of FIG. 20.
Figure 22:
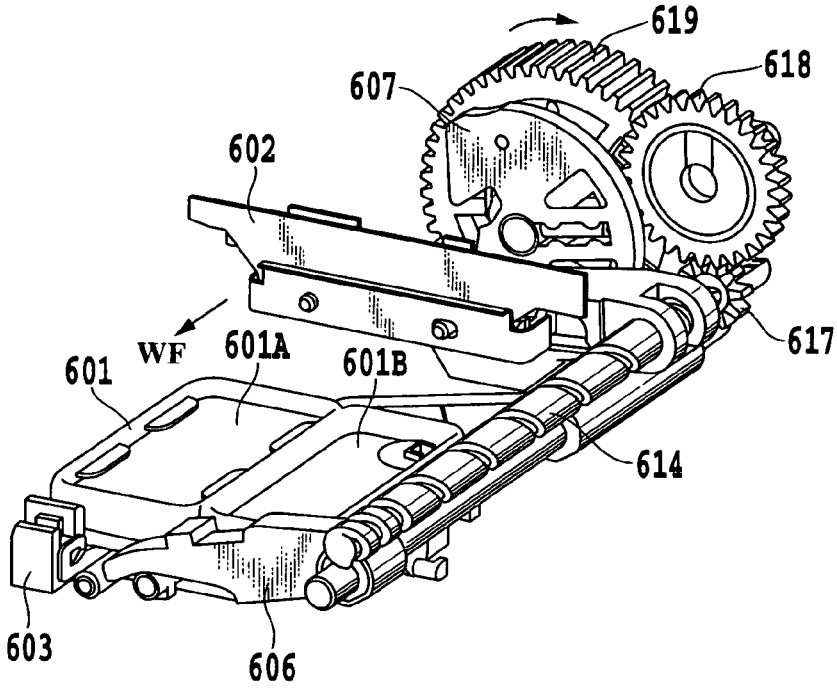
FIG. 22 is a perspective view showing the wiper and the cap at a position CD in the cam chart of FIG. 20.
Figure 23:
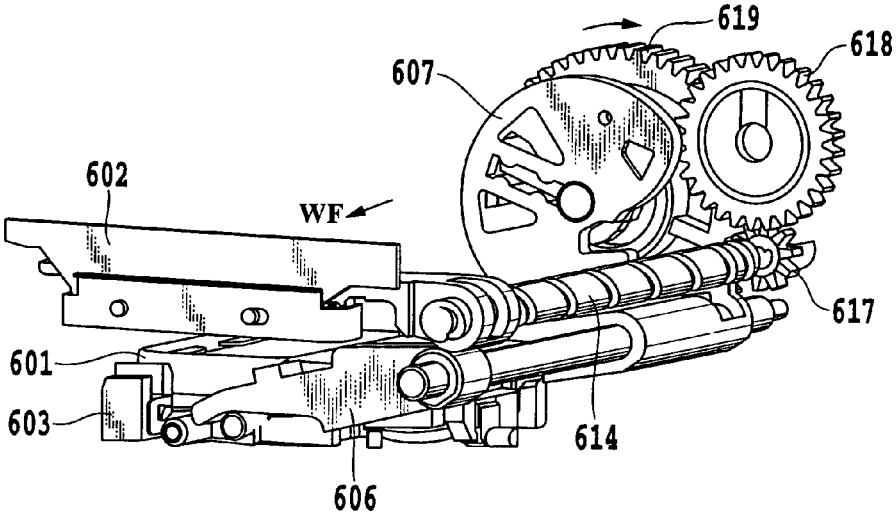
FIG. 23 is a perspective view showing the wiper and the cap at a position WF in the cam chart of FIG. 20.

FIG. 20 is a cam chart showing operations of the wiper 602 and the cap 601. FIG. 21 is a perspective view showing the wiper 602 and the cap 601 when they are at a CU position in the cam chart of FIG. 20. FIG. 22 is a perspective view showing the wiper 602 and the cap 601 when they are at a CD position in the cam chart of FIG. 20. FIG. 23 is a perspective view showing the wiper 602 and the cap 601 when they are at a WF position in the cam chart of FIG. 20.

The cap cam gear 619 only reciprocally rotates according to the rotating direction (CCW, CW) of the AP motor 107 (FIG. 2) in a range from a wiping end position WF of the wiper 602 as a starting position to a capping completion position CU of the capping unit 601 as an end position. The cap 601 moves up or down as the cap cam gear 619 rotates. The cap 601 moves up to perform a capping action. When the cap cam gear 619 rotates in a direction from the wiping end position WF to the capping completion position CU, the wiper 602 moves from the front toward the rear over the lowered cap 601. Then, after the wiper 602 stops at around the position CD, the cap 601 moves up and stops at the position CU where it caps the nozzle face 512 of the print head. Conversely, when the cap cam gear 619 rotates in a direction from the capping completion position CU toward the wiping end position WF, the cap 601 moves down. Then, after the cap 601 stops at around the position CD, the wiper 602 moves from the rear toward the front over the lowered cap 601 until it reaches the position WF where it stops.

Figure 24:
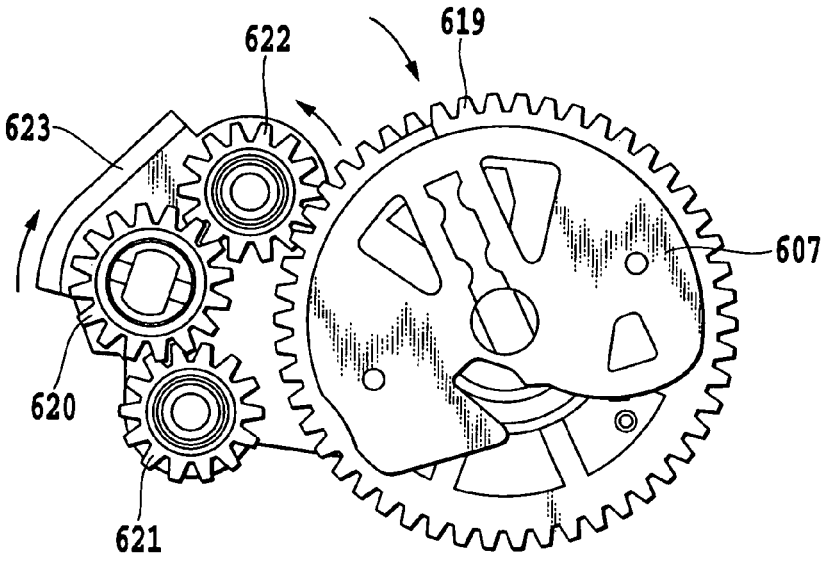
FIG. 24 is a front view showing a drive input unit for a cap gear during a CCW rotation of an AP motor of FIG. 2.

FIG. 24 shows a front view of a drive input unit that drives the cap cam gear 619 when the AP motor 107 (FIG. 2) rotates in the CCW direction.

A driving force of the AP motor 107 as a drive source is transmitted through a plurality of gears to a sun gear 620 on the PG base 604. The cap cam gear 619 is supplied a driving force from the sun gear 620 through a planetary gear A 621 and a planetary gear B 622. The planetary gear A 621 and the planetary gear B 622 are rotatably mounted on a pendulum arm 623 which is rotatably mounted with respect to a rotating shaft of the sun gear 620. According to the rotating direction of the sun gear 620, one of the planetary gear A 621 and the planetary gear B 622 transmits a driving force to the cap cam gear 619. For the cap 601 to be downed and the wiper 602 to be moved from the rear to the front, the AP motor 107 is rotated in the CCW direction to apply a driving force from the planetary gear B 622 to the cap cam gear 619. When, after moving from the rear to the front, the wiper 602 stops at the position WF, a notched portion 619*b* is situated at that part of the cap cam gear 619 which is engaged by the planetary gear B 622. Therefore, if the planetary gear B 622 should be rotated more than a specified number of turns by the AP motor 107, no driving force is transmitted to the cap cam gear 619.

Figure 25:
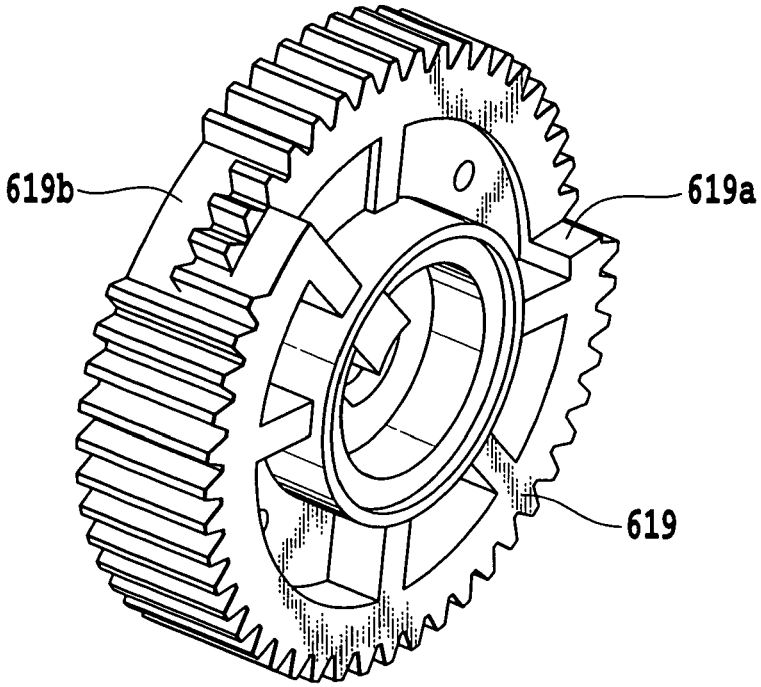
FIG. 25 is a perspective view of a cap cam gear of FIG. 23.

FIG. 25 is a perspective view of the cap cam gear 619.

In the cap cam gear 619, a notched portion 619*a* is to interrupt the transmission of a driving force to the blade idler gear 618 and the notched portion 619*b* is to interrupt the transmission of a driving force from the planetary gear B 622.

Figure 26:
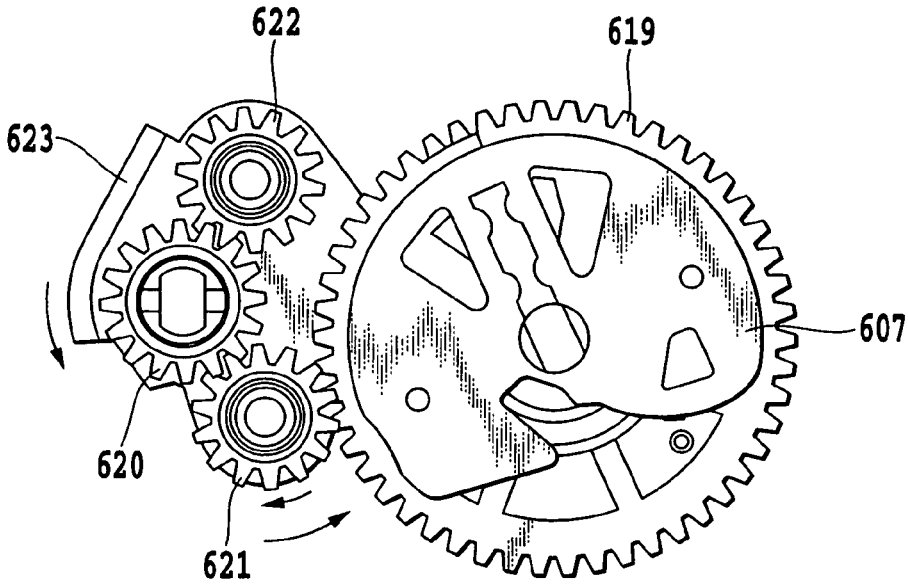
FIG. 26 is a front view showing the drive input unit for the cap gear during a CW rotation of the AP motor of FIG. 2.

FIG. 26 shows a front view of a drive input unit that drives the cap cam gear 619 when the AP motor 107 rotates in the CW direction.

Reversing the direction of rotation of the AP motor 107 results in a driving force being transmitted to the cap cam gear 619 from the planetary gear A 621 instead of the planetary gear B 622. With the cap cam gear 619 supplied a driving force from the planetary gear A 621, the cap 601 is moved up after the wiper 602 has been moved from the front toward the rear.

By switching the direction of rotation of the AP motor 107 as described above, the operation of the cap 601 and the wiper 602 can be transformed.

Figure 27:
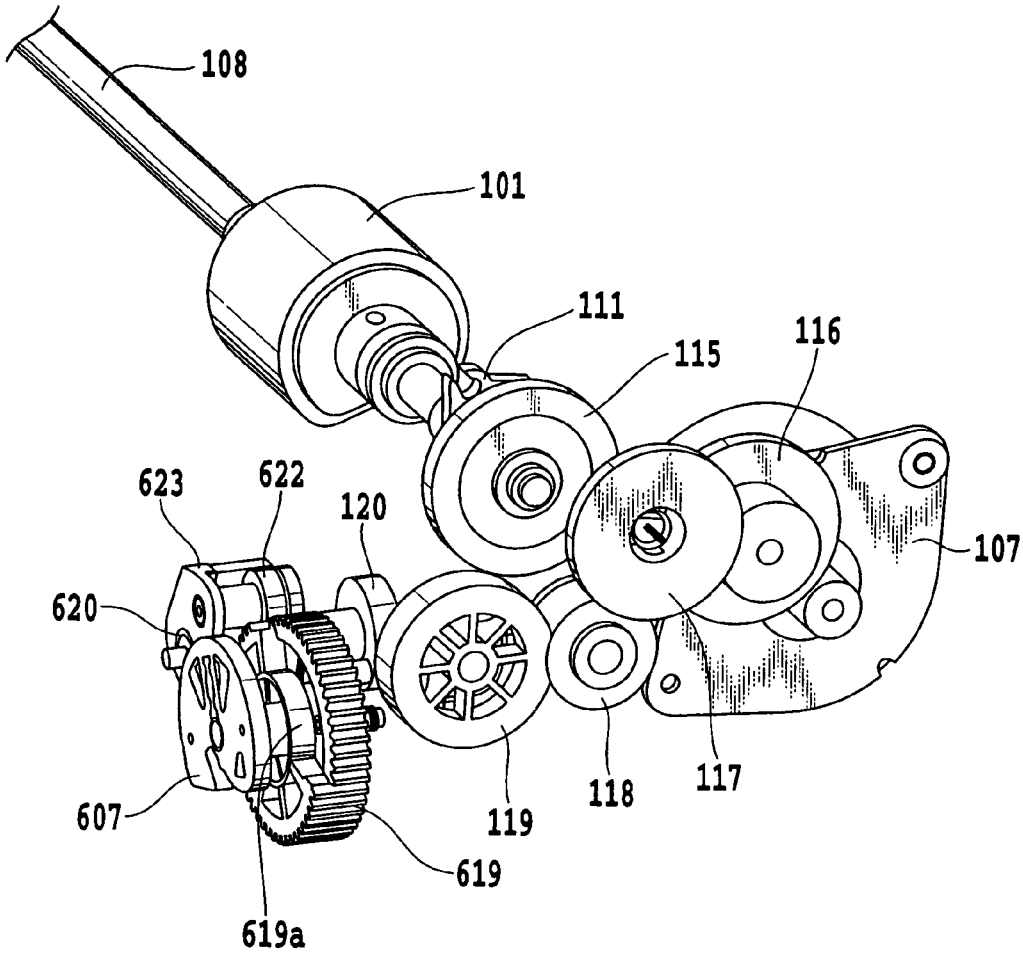
FIG. 27 is a perspective view showing parts of a transmission mechanism for transmitting a driving force to the automatic paper feed unit and the recovery unit in the printing apparatus of FIG. 1.

FIG. 27 is a perspective view showing constitutional parts of a driving force transmission mechanism for transmitting a driving force to the automatic paper feed unit 100 and the recovery unit 600.

A driving force for the recovery unit 600 is transmitted from the AP motor 107 to a sun gear 120 through the AP gear a 116, the AP gear b 117, an AP gear c 118, an AP bevel gear 119, and a PG bevel gear 620. A driving force for the paper feed rollers 101 in the automatic paper feed unit 100 is transmitted from the AP motor 107 through the AP gear a 116, the AP gear b 117 and the paper feed roller gear 115. As for the transmission of a driving force to the paper feed rollers 101, a feed delay collar 114 rotatably mounted on the paper feed roller shaft 108 sets a dead zone in which a driving force is not transmitted.

Figure 28:
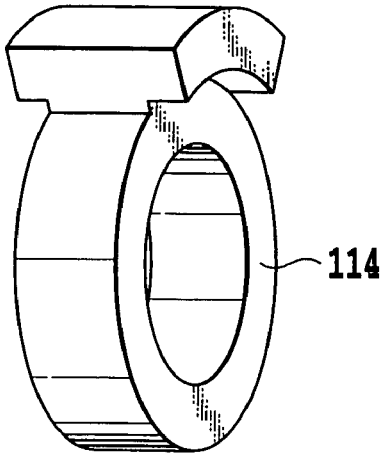
FIG. 28 is a perspective view of a feed delay collar installed in a paper feed roller of FIG. 27.

FIG. 28 is a perspective view of the feed delay collar 114.

The feed delay collar 114 is shaped like a ring with a protrusion at one portion thereof and two of them are rotatably mounted on the paper feed roller shaft 108.

Figure 29:
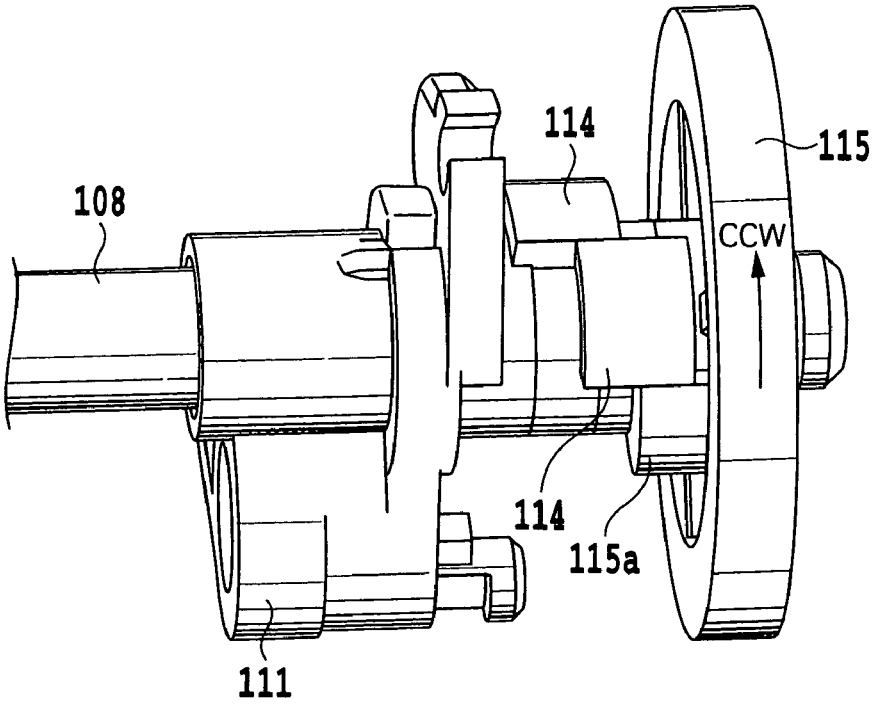
FIG. 29 is a perspective view showing an end portion of a paper feed roller shaft attached with the feed delay collar of FIG. 28.

FIG. 29 is a perspective view showing an end portion of the paper feed roller shaft 108 attached with the feed delay collars 114.

The direction of rotation of the AP motor 107 during the execution of the paper feed operation is defined as CCW A driving force of the AP motor 107 during the CCW rotation is transmitted to the paper feed roller gear 115 through a plurality of gears. The paper feed roller gear 115 is rotatably mounted on the paper feed roller shaft 108 so that the rotation of the paper feed roller gear 115 does not result in an immediate rotation of the paper feed roller shaft 108. When, after the paper feed roller gear 115 has rotated a predetermined distance, a projection 115*a* formed at one end of the paper feed roller gear 115 engages the protrusion of the right side feed delay collar 114 in FIG. 29, the feed delay collar 114 is rotated. Similarly, after the right side feed delay collar 114 rotates a predetermined distance, its rotating force is transmitted to the left side feed delay collar 114 in FIG. 29. Then, the protrusion of the left side feed delay collar 114 in FIG. 29 engages a projection of the pressure plate cams 111 secured to the paper feed roller shaft 108, causing the paper feed roller shaft 108 to start rotating. A dead zone of the feed delay collar 114 mounted on the paper feed roller shaft 108 (a rotary distance traveled from when a driving force is received until it is transmitted) is set larger than the drive distance of the AP motor 107 from the position CU to the position WF in the cam chart of FIG. 20.

Figure 30:
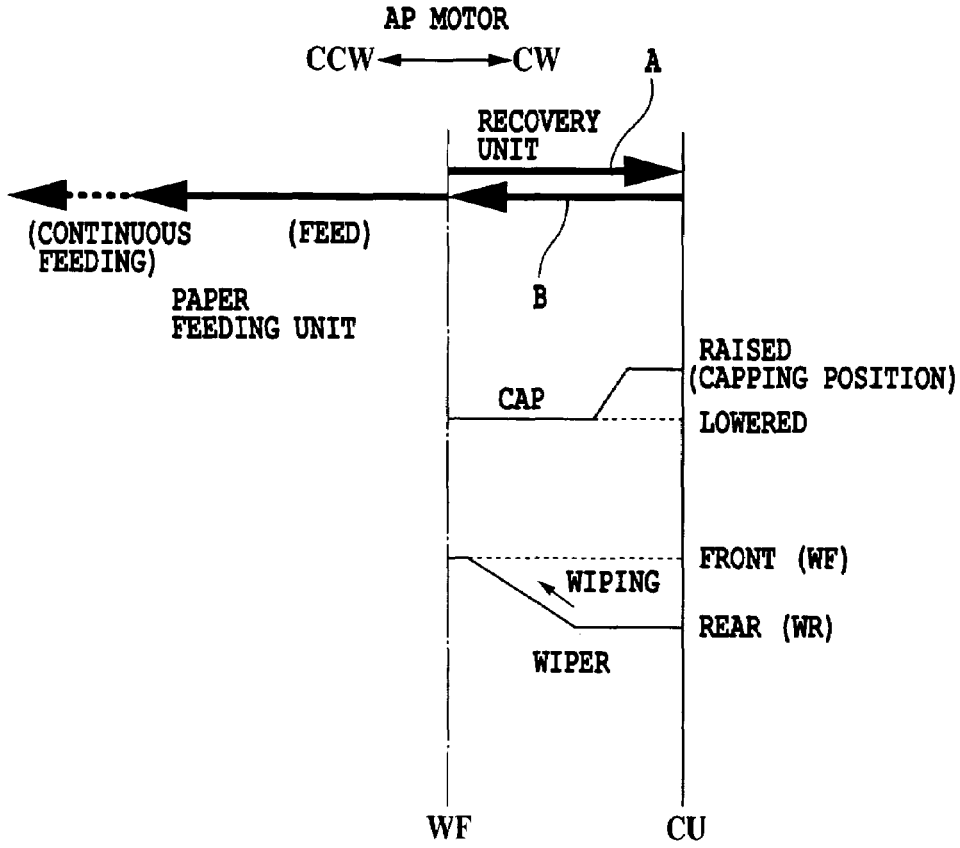
FIG. 30 is an explanatory diagram showing an operation of the cap, wiper and paper feed roller of FIG. 15.

FIG. 30 is a chart showing the operations of the cap 601, the wiper 602 and the paper feed rollers 101.

When the AP motor 107 continues to rotate in the CCW direction, i.e., when the paper feed is performed continuously, the cap 601 remains in a lowered position and the planetary gear B 622 idles at the notched portion 619*b* of the cap cam gear 619. The driving force therefore is not transmitted to the recovery unit 600, leaving only the paper feed rollers 101 to continue rotating in the forward direction. In this state, if the AP motor 107 is reversed and rotates in the CW direction, the feed delay collars is 114 block the driving force from being transmitted to the paper feed rollers 101 and the cap cam gear 619 is rotated by the planetary gear A 621. The CW rotation of the AP motor 107 (indicated by A in FIG. 30) causes the wiper 602 to move from the front (WF) toward the rear (WR) and the cap 601 to move upward. By detecting the positions of the cap cam gear 619 and the cap cam 607 using sensors (not shown), it is possible to prevent an unnecessarily large reverse rotation of the AP motor 107 and to detect the positions of the cap 601 and the wiper 602.

If the AP motor 107, while rotating in the CW direction as shown at A of FIG. 30, reverses to the CCW direction at any arbitrary position, the feed delay collars 114 are activated. That is, the paper feed rollers 101 are kept from rotating until the wiper 602 finishes moving from the forward (WF) to the rear (WR) and the cap cam gear 619 returns to the notched portion 619*b* to interrupt the driving force.

When the automatic paper feed unit 100 and the recovery unit 600 are to be initialized, the AP motor 107 needs to be rotated a predetermined distance in the CCW direction, as shown at B of FIG. 30. This causes the cap 601 to move down and the wiper 602 to stop at the front (WF) position. Then, by continuing the rotation of the AP motor 107 in the CCW direction, the positioning of the paper feed rollers 101 are performed using the ASF sensor switch 113.

Figure 31:
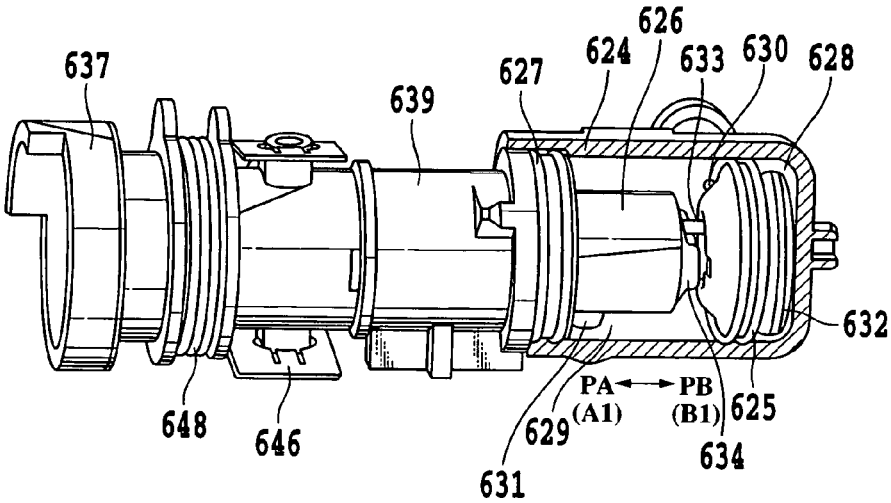
FIG. 31 is a partly cutaway perspective view showing a suction pump unit of FIG. 15.

FIG. 31 is a partly cutaway perspective view of the suction pump unit.

The suction pump unit is a piston pump that produces a pressure by moving a piston 625 in a circular cylinder 624. In the cylinder 624, a piston shaft 626 is arranged reciprocally movable in directions of arrows PA (A1), PB (B1). FIG. 31 shows the piston shaft 626 at the top dead point, i.e., an extreme end of its stroke in the direction of arrow PB in the figure. The piston shaft 626 moves in the cylinder 624, with its outer circumferential surface in sliding contact with a cylinder seal 627 which is a rubber member arranged on and secured to an inner surface of the cylinder 624. The cylinder 624 is formed with a suction port 630 to suck out ink not contributing to image printing from the nozzles of the print head. The suction port 630 is connected to an interior of the cap 601 through a tube 612. The cylinder 624 is also provided with a discharge port 631 for discharging ink from the pump. The piston shaft 626 has a piston 625 made of rubber whose outer circumferential surface is in sliding contact with the corresponding part of an inner circumferential surface of the cylinder 624. An inner diameter of the piston 625 is so set as to form a predetermined clearance between the piston 625 and the piston shaft 626. That is, the piston 625 is loosely fitted over the piston shaft 626.

A space inside the cylinder 624 is divided by the piston 625 into a first chamber 628 and a second chamber 629. The piston shaft 626 is integrally formed with a closed flange portion 632 whose outer diameter is smaller than the corresponding inner diameter of the cylinder 624 and larger than the inner diameter of the piston 625. On an open flange portion 633 of the piston shaft 626, a piston stopper 634 opposing the piston 625 is integrally formed. The open flange portion 633 is situated on that side of the piston 625 opposite the closed flange portion 632. An outer diameter of the piston stopper 634 is smaller than the inner diameter of the cylinder 624 and larger than the inner diameter of the piston 625. The piston stopper 634 has a plurality of communication grooves that communicate a clearance space between the inner diameter of the piston 625 and the piston shaft 626 with a space in the first chamber 628.

Next, the operation of the suction pump unit will be explained.

Figure 32:
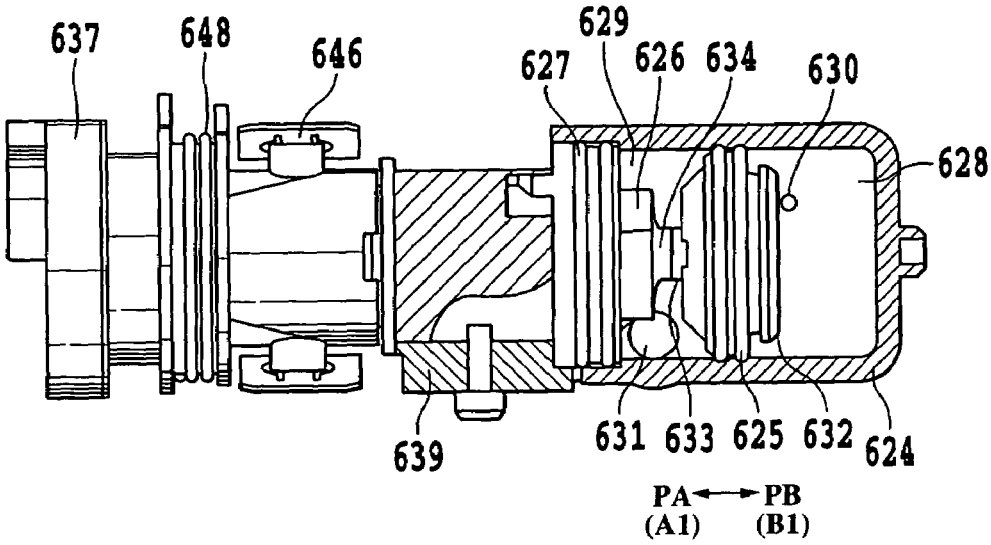
FIG. 32 is a cross-sectional view showing the suction pump unit when the piston shaft of FIG. 31 moves in a direction of arrow PA.

FIG. 32 is a partly cutaway cross-section showing a state in which the piston shaft 626 has moved in the direction of arrow PA from the position of FIG. 31 so that the piston 625 has passed the position of the suction port 630. As the piston shaft 626 moves in the direction of arrow PA, the piston 625 comes into intimate contact with the closed flange portion 632, isolating the first chamber 628 and the second chamber 629 from each other. As the second chamber 629 is compressed, a positive pressure is generated, discharging the ink therein (not shown) from the discharge port 631. Since the first chamber 628 is expanded, a negative pressure is produced therein, causing ink to be sucked from the suction port 630.

Figure 33:
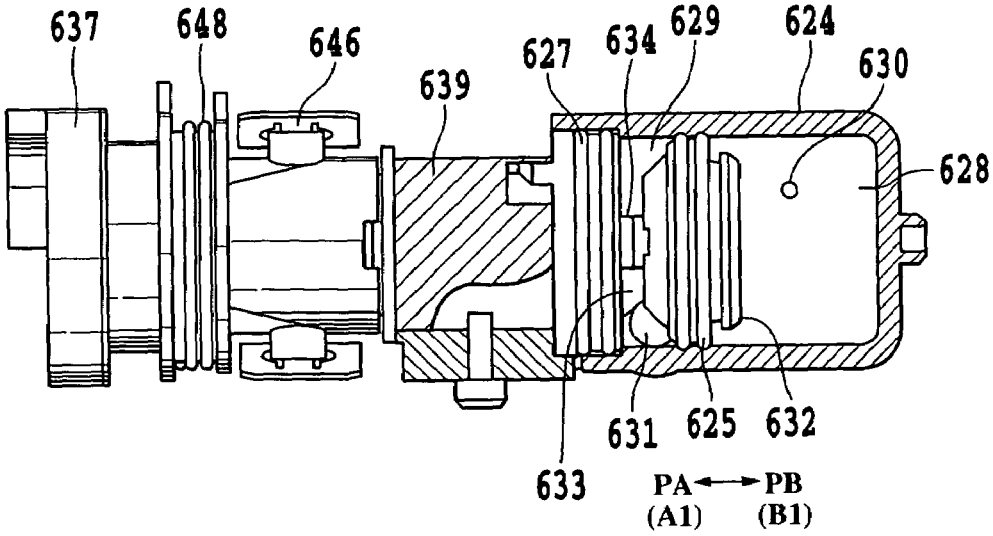
FIG. 33 is a cross-sectional view showing the suction pump unit when the piston shaft further moves in a direction of arrow PA from the position of FIG. 32 to the extreme position.

FIG. 33 is a partly cutaway cross-section showing a state in which the piston shaft 626 has further moved in the direction of arrow PA from the position of FIG. 32 and the piston 625 has reached a bottom dead point. In the state of FIG. 33, the volume of the second chamber 629 is minimum and the volume of the first chamber 628 is maximum, completing the suction and discharge operations.

Figure 34:
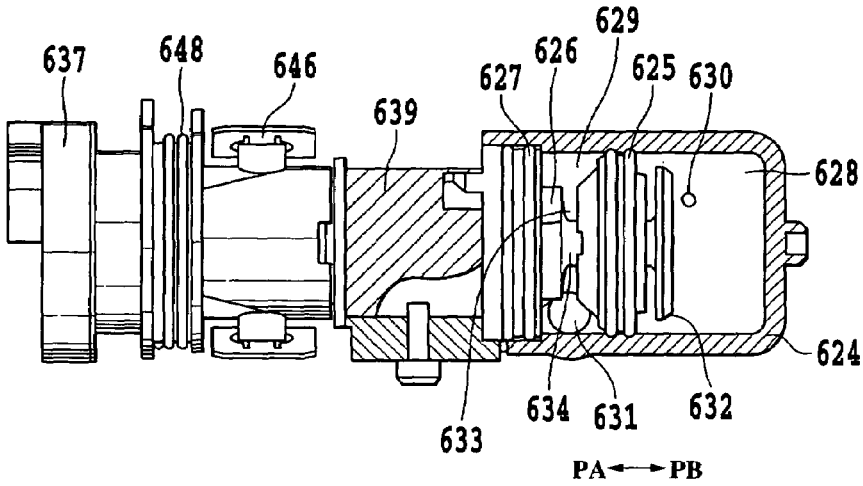
FIG. 34 is a cross-sectional view showing the suction pump unit when the piston shaft of FIG. 33 moves some distance in a direction of arrow PB.

FIG. 34 is a partly cutaway cross-section showing a state in which the piston shaft 626 has moved some distance in the direction of arrow PB from the bottom dead point of FIG. 33. As the piston shaft 626 moves in the direction of arrow PB, the piston 625 comes into intimate contact with the piston stopper 634. The first chamber 628 and the second chamber 629 communicate with each other through the clearance between the outer circumferential surface of the piston shaft 626 and the inner circumferential surface of the piston 625 and through the communication grooves In this state, as the piston shaft 626 moves in the direction of arrow PB, the second chamber 629 is expanded producing a negative pressure and the first chamber 628 is compressed producing a positive pressure. A flow resistance of the suction port 630 is set higher than a flow resistance of a space ranging from the clearance between the outer circumferential surface of the piston shaft 626 and the inner circumferential surface of the piston 625 to the communication grooves. Thus, a pressure difference between the first chamber 628 and the second chamber 629 causes the sucked ink in the first chamber 628 to flow into the second chamber 629 from the clearance between the outer circumferential surface of the piston shaft 626 and the inner circumferential surface of the piston 625 through the communication grooves.

As described above, the reciprocal motion of the piston shaft 626 in the directions of arrows PA, PB can suck ink from the suction port 630 into the first chamber 628 and cause the ink to flow from the first chamber 628 to the second chamber 629 for discharging from the discharge port 631.

Figure 35:
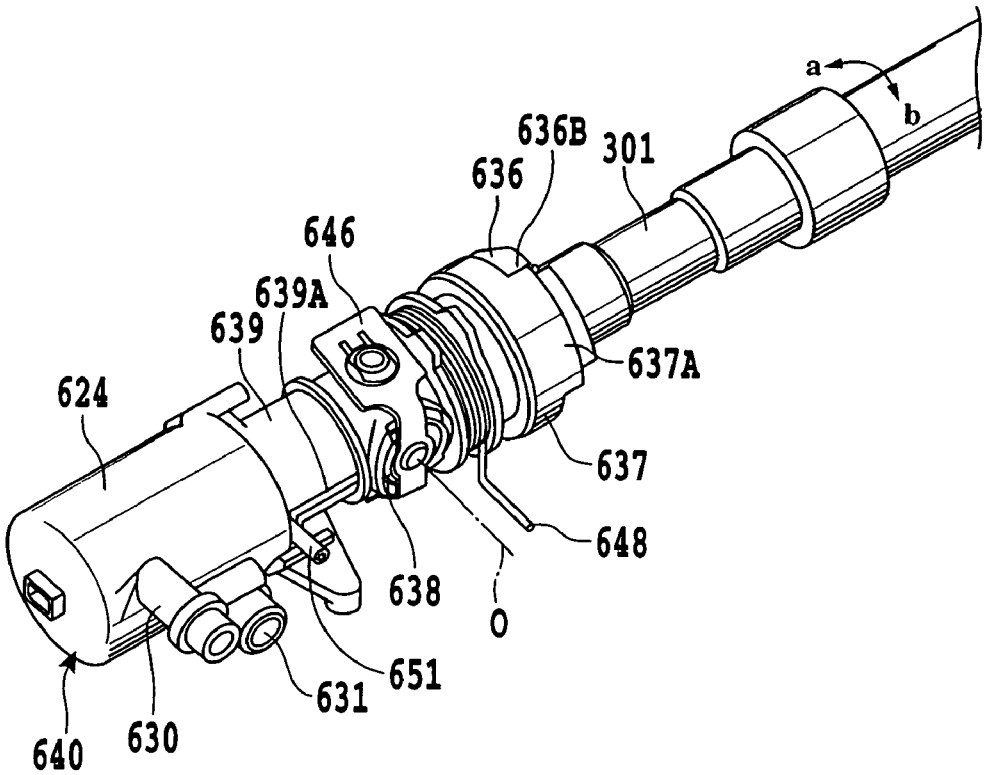
FIG. 35 is a perspective view of a connecting portion between the suction pump unit of FIG. 31 and the printer body.

FIG. 35 is a perspective view showing an essential part of a connecting mechanism between the suction pump unit and the printer body.

The suction pump unit is mounted at one end of the discharge roller 301. At the other end of the discharge roller 301, the discharge pulley 303 is mounted. The discharge roller 301 and the piston shaft 626 are arranged in series to have their axes aligned. The suction pump unit is supplied a driving force of the LF motor 206 through the discharge roller 301. A transmission unit for transmitting a driving force to the suction pump unit comprises, as detailed later, a clutch spring 635 wound around the discharge roller 301, a pump delay collar 636 rotatably mounted on the piston shaft 626, a control ring 637 rotatably mounted on the piston shaft 626, and a boat-shaped piece 638 held rotatable on the control ring 637 by a stopper 646.

Figure 36:
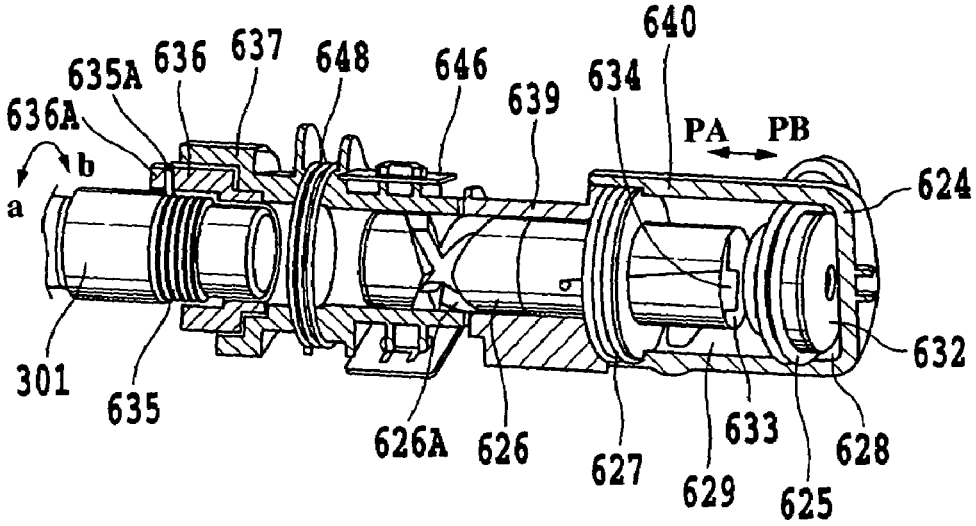
FIG. 36 is a cross-sectional perspective view of the connecting portion between the suction pump unit of FIG. 35 and the printer body.

FIG. 36 is a cross-sectional perspective view showing an essential part of the connecting mechanism between the suction pump unit and the printer body.

One end of the discharge roller 301 is wound with the clutch spring 635. When the LF motor 206 rotates in the forward direction to drive the discharge roller 301 in a direction of arrow a to feed the print sheet P from the transport unit 200 to the discharge unit 300, this direction of rotation is the one that loosens the clutch spring 635. Therefore, the driving force of the discharge roller 301 in the direction of arrow a is not transmitted to the suction pump unit. An auxiliary clutch spring 648 functions as an adjust load to reliably loosen the clutch spring 635. The auxiliary clutch spring 648 and the clutch spring 635 are wound in opposite directions. The loosening torque of the clutch spring 635 is set smaller than a tightening torque of the auxiliary clutch spring 648, and the tightening torque of the clutch spring 635 is set larger than the sum of the loosening torque of the auxiliary clutch spring 648 and the drive torque of the suction pump unit.

When the LF motor 206 reverses to drive the discharge roller 301 in the direction of arrow b, this direction of rotation is the one that tightens the clutch spring 635, i.e., transmits a driving force to the piston pump 640. The suction pump unit is not activated immediately. That is, the suction pump unit is not started until a sequence of operations—engaging an arm of the clutch spring 635 with a projection at one end of the pump delay collar 636, rotating the pump delay collar 636, engaging a projection at the other end of the pump delay collar 636 with a projection of the control ring 637 and rotating the control ring 637—is completed. As described above, in the transport unit 200, the LF roller 201 may at times be reversed to feed the print sheet P to the print start position for executing the printing operation For this reason, the rotation dead zone provided by the pump delay collar 636 is set large enough to keep the suction pump unit from being activated during the execution of the printing operation.

Figure 37:
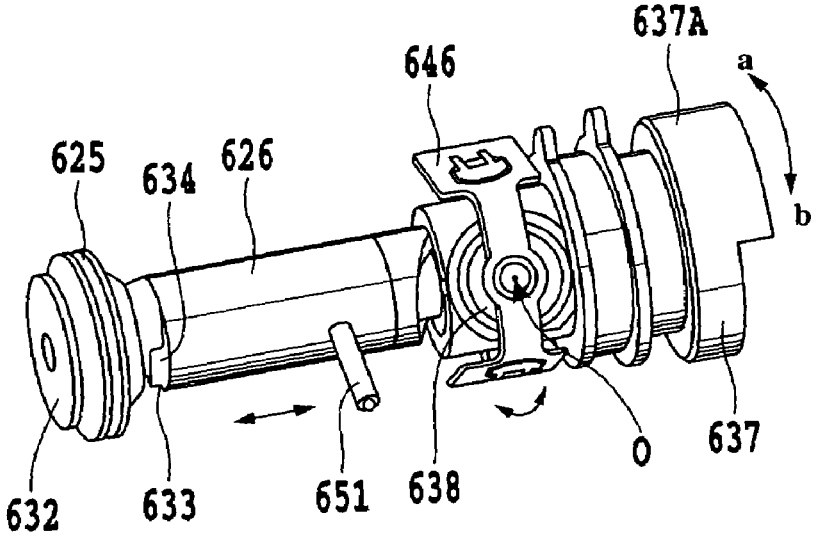
FIG. 37 is a perspective view showing a piston portion of FIG. 36.
Figure 38:
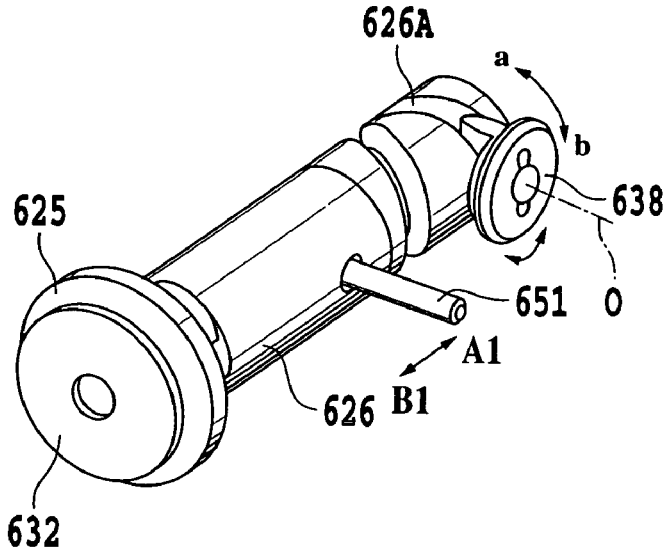
FIG. 38 is a perspective view showing the piston portion of FIG. 36.

FIG. 37 and FIG. 38 are perspective views of the piston 625 and its associated components.

At one end of the piston shaft 626 opposite the other end where the piston 625 is mounted, the piston shaft 626 has a continuous groove formed therein, in which the boat-shaped piece 638 attached to the control ring 637 is movably fitted. The piston shaft 626 itself does not rotate but is allowed only a reciprocal motion. That is, a piston pin 651 provided on the piston shaft 626 is guided along a groove formed in a sleeve 639 so that the piston shaft 626 reciprocally moves along the cylinder 624. Therefore, as the control ring 637 rotates, the piston shaft 626 is pushed by the boat-shaped piece 638 fitted in the continuous groove, thus performing a reciprocal movement. At this time, by detecting the position of the piston shaft 626 by a sensor, it is possible to control the amount of ink to be sucked.

Next, the suction operation of the suction pump unit and a series of recovery operation steps including wiping will be explained.

Figure 39:
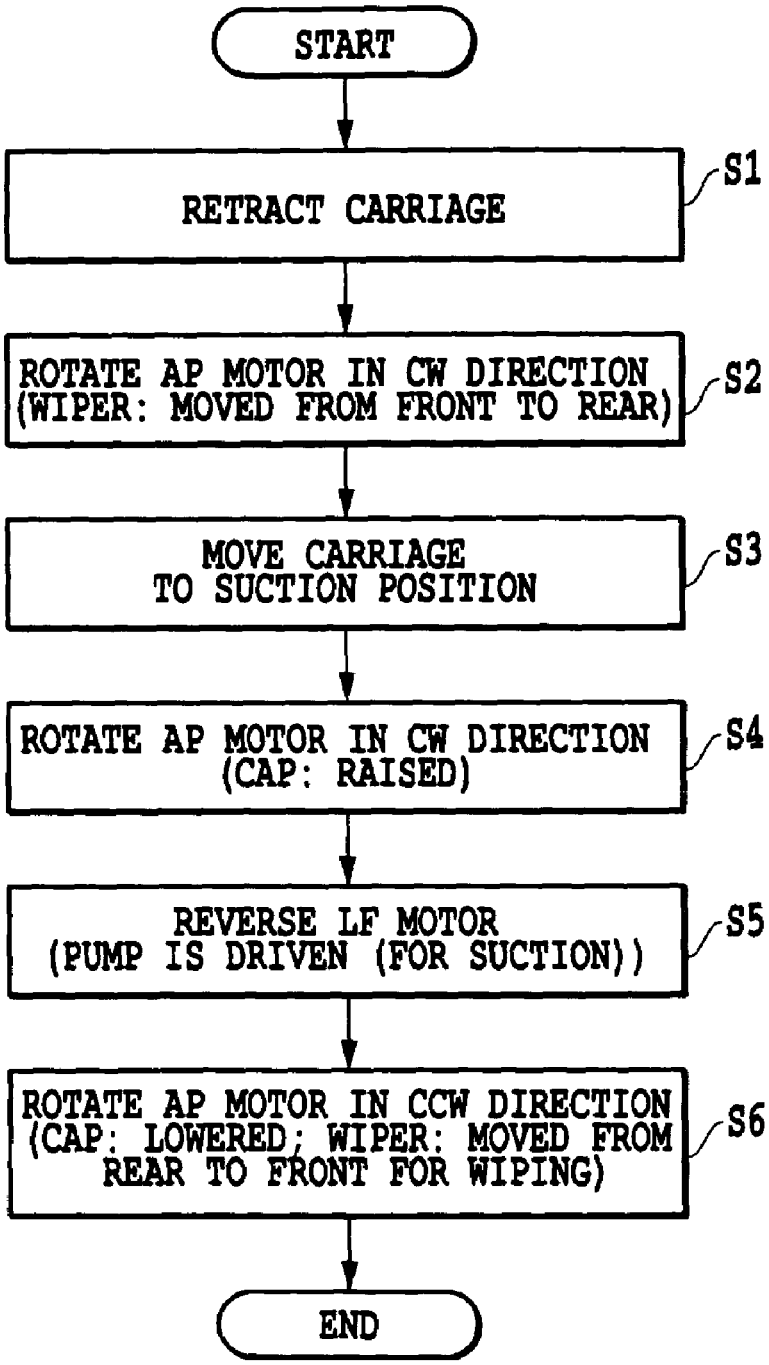
FIG. 39 is a flow chart showing a recovery operation in the printing apparatus of FIG. 1.
Figure 40:
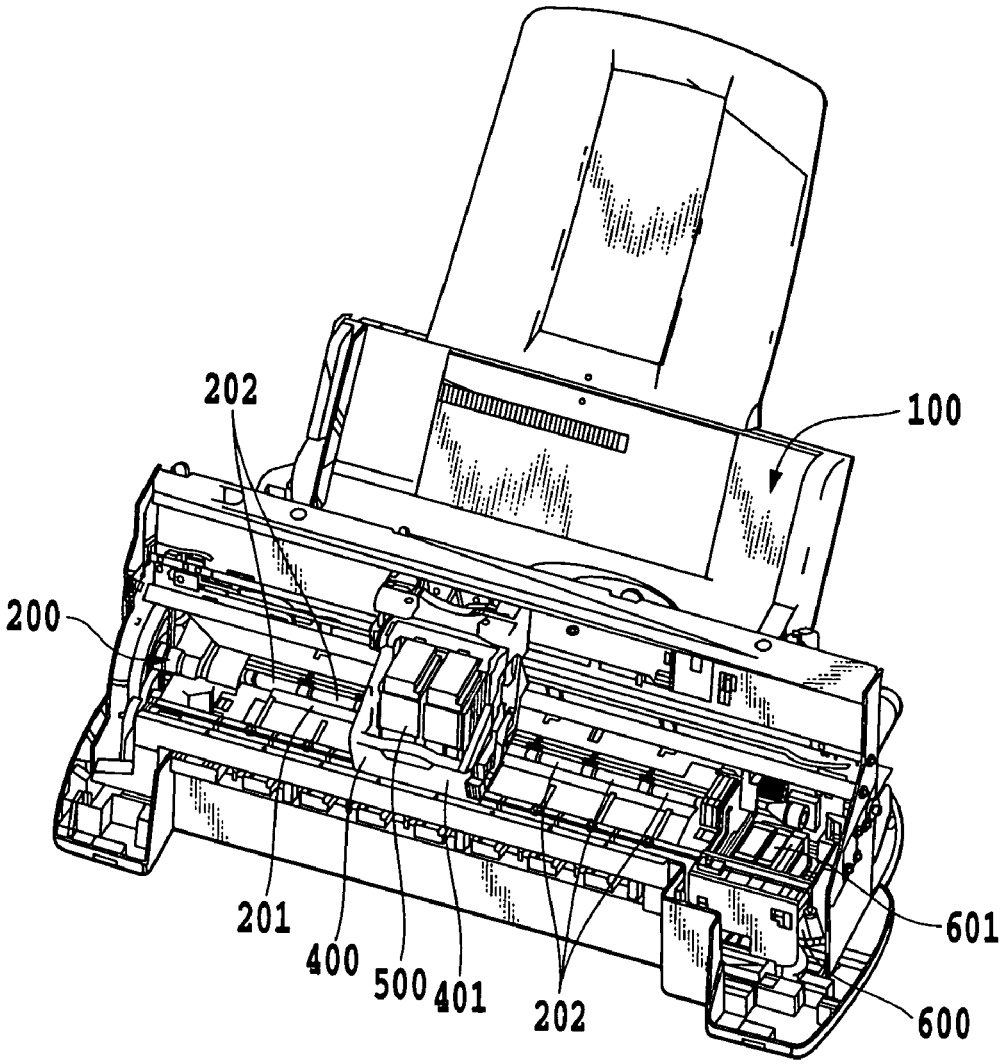
FIG. 40 is a perspective view of a conventional ink jet printer.

FIG. 39 is a flow chart showing a recovery operation First, when the cap cam gear 619 is at the position WF and the carriage 401 is at a position retracted from the recovery unit 600 (step S1), the AP motor 107 is rotated a predetermined distance in the CW direction (step S2). As a result, the wiper 602 moves from the front (WF) to the rear (WR), with the cap 601 at a lowered position. Next, the carriage 401 is moved to the capping position where the nozzle face 512 of the print head in the print head cartridge 501 opposes the cap 601 (step S3). Then, the AP motor 107 is further rotated a predetermined distance in the CW direction to move the cap 601 upward to bring it into hermetic contact with the nozzle face 512 of the print head (capping: step S4).

Then, the LF motor 206 is reversed to activate the piston pump 640 to generate a negative pressure, and the negative pressure is introduced into the cap 601 to forcibly suck ink not suited for printing and bubbles from the nozzles of the print head for discharging (step S5). Then the AP motor 107 is driven in the CCW direction to activate the cap lever 606 to lower the cap 601 away from the print head (decapping). The wiper 602 is moved from the rear (WR) to the front (WF) above the cap 601 to wipe the nozzle face 512 (step S6).

(Detailed Description of Piston Pump)

Next, by referring to FIGS. 36–38, 31–33 and 41, the construction and operation of the piston pump 640 will be explained in more detail.

First, referring to FIG. 36, a detailed construction of the piston pump 640 will be explained.

The discharge roller 301, as described above, is rotated in a direction of arrow a by the forward rotation of the LF motor 206 to feed the print sheet P from the transport unit 200 to the discharge unit 300. The clutch spring 635 wound on the end of the discharge roller 301 is interposed between the end of the discharge roller 301 and the pump delay collar 636. The direction of arrow a represents a direction that loosens the clutch spring 635. Therefore, when the discharge roller 301 rotates in the direction of arrow a, the rotating force of the roller is not transmitted to the pump delay collar 636 and the piston pump 640 is not driven. The auxiliary clutch spring 648 wound on the control ring 637 is interposed between the control ring 637 and an outer predetermined position. The auxiliary clutch spring 648 is provided as an adjust load to reliably loosen the clutch spring 635 and its winding direction is reverse to that of the clutch spring 635. A loosening torque of the clutch spring 635 is set smaller than a tightening torque of the auxiliary clutch spring 648, and a tightening torque of the clutch spring 635 is set larger than the sum of the loosening torque of the auxiliary clutch spring 648 and the drive torque of the piston pump 640.

When the discharge roller 301 is rotated in the direction of arrow b by the reverse rotation of the LF motor 206, since the direction of arrow b is the one that tightens the clutch spring 635, an arm 635A of the clutch spring 635 engages one projection 636A of the pump delay collar 636, transmitting the rotating force of the discharge roller 301 to the pump delay collar 636. Then, the pump delay collar 636 rotates a predetermined distance in the direction of arrow b and the other projection 636B (FIG. 35) engages a projection 637A of the control ring 637, which is then rotated in the direction of arrow b together with the pump delay collar 636. Therefore, the control ring 637 is not driven until the pump delay collar 636 is rotated a predetermined distance in the direction of arrow b and the other projection 636B of the pump delay collar 636 engages the projection 637A of the control ring 637. That is, the control ring 637 is not driven immediately when the discharge roller 301 starts rotating in the direction of arrow b but begins to be rotated in the direction of arrow b only after the discharge roller 301 has rotated a predetermined distance in the direction of arrow b, i.e., after a predetermined delay. As described above, the reason for setting the rotation dead zone by using the pump delay collar 636 is that the LF motor 206 is at times slightly reversed to transport the print sheet P to the print start position by the transport unit 200 at the start of the printing operation. During that small reverse rotation, the control ring 637 is not rotated and the piston pump 640 is also not activated.

Next, referring to FIG. 37 and FIG. 38, the construction of the piston portion of the piston pump 640 will be explained in more detail.

The piston shaft 626 is formed with an endless, continuous spiral groove (screw groove) 626A at one end thereof opposite the other end where the piston 625 is mounted This groove 626A is endlessly continuous and shaped like a letter 8 when the outer circumferential surface of the piston shaft 626 is unfolded and spread into a plane. Hence, the continuous groove 626A has one intersecting portion. In this groove 626A is slidably fitted a protruding portion of the boat-shaped piece 638 mounted on the control ring 637. According to the orientation of that part of the groove 626A in which the protruding portion of the boat-shaped piece 638 is fitted, the piece 638 rotates about its axis O. The piston pin 651 provided on the piston shaft 626 is reciprocally guided axially in the direction of arrow A1, B1 by the groove 639A formed in the sleeve 639. This keeps the piston shaft 626 from rotating about its own axis but allows it to only reciprocally move along its axis in the direction of arrows A1, B1.

Thus, rotating the control ring 637 at a fixed position in the direction of arrow b causes the boat-shaped piece 638 to rotate together with the control ring 637 in the direction of arrow b while keeping its protruding portion in sliding engagement with the groove 626A in the piston shaft 626. So, the protruding portion of the boat-shaped piece 638 moves relative to the piston shaft 626 along the groove 626A. As a result, the boat-shaped piece 638, while sliding along the groove 626A, pushes the piston shaft 626 reciprocally in the direction of arrows A1, B1. That is, as the boat-shaped piece 638 continuously rotates together with the control ring 637 in the direction of arrow b, the protruding portion of the boat-shaped piece 638 continuously moves along the groove 626A, causing the piston shaft 626 to reciprocate in the direction of arrows A1, B1. At this time, by detecting the position of the piston shaft 626 by a sensor, it is possible to control the amount of ink to be sucked by the piston pump 640.

Next, by referring to FIG. 31, the construction of the cylinder 624 in the piston pump 640 will be described in more detail.

The piston pump 640 of this embodiment produces a pressure by moving the piston 625 in the circular cylinder 624. In the cylinder 624, the piston shaft 626 is arranged reciprocally movable in directions of arrows A1. B1. FIG. 31 represents a state in which the piston shaft 626 has moved in the direction of arrow B1 to an extreme end of its stroke and is situated at a top dead point. The cylinder seal 627 made of rubber is arranged on and secured to an inner surface of the cylinder 624. The piston shaft 626 moves in the cylinder 624, with its outer circumferential surface in sliding contact with the cylinder seal 627. The cylinder 624 is formed with the suction port 630 to suck ink from the nozzles of the print head (not shown) in the printing unit 400 (recovery operation by suction). The recovery unit 600 has a cap (not shown) for capping the nozzle face of the print head, and an interior of the cap is connected to the suction port 630 through a tube (not shown). The cylinder 624 is also provided with the discharge port 631. The piston shaft 626 has a piston 625 made of rubber, whose outer circumference is in sliding contact with an inner circumference of the cylinder 624. The piston 625 is loosely fitted over the piston shaft 626 so that a predetermined clearance is formed between the inner circumference of the piston 625 and the outer circumference of the piston shaft 626. A space inside the cylinder 624 is divided by the piston 625 into the first chamber 628 and the second chamber 629.

The piston shaft 626 is integrally formed with the closed flange portion 632 whose outer diameter is smaller than the inner diameter of the cylinder 624 and larger than the inner diameter of the piston 625. On the open flange portion 633 of the piston shaft 626, the piston stopper 634 opposing the piston 625 is integrally formed. The open flange portion 633 is situated on that side of the piston 625 opposite the closed flange portion 632. An outer diameter of the piston stopper 634 is smaller than the inner diameter of the cylinder 624 and larger than the inner diameter of the piston 625. The piston stopper 634 has the plurality of communication grooves that communicate the clearance space between the inner circumference of the piston 625 and the piston shaft 626 with a space in the first chamber 628.

FIG. 32 is a cross-section showing a state in which the piston shaft 626 has moved in the direction of arrow A1 from the position of FIG. 31 so that the piston 625 has passed the position of the suction port 630. As the piston shaft 626 moves in the direction of arrow A1, the piston 625 comes into intimate contact with the closed flange portion 632, isolating the first chamber 628 and the second chamber 629 from each other. As the second chamber 629 is compressed, a positive pressure is generated discharging the ink therein (not shown) from the discharge port 631. Since the first chamber 628 is expanded, a negative pressure is produced therein, causing ink not contributing to image printing to be sucked from the nozzles of the print head through the suction port 630 (suction-based recovery operation).

FIG. 33 is a cross-section showing a state in which the piston shaft 626 has further moved in the direction of arrow A1 from the position of FIG. 32 and the piston 625 has reached a bottom dead point. In the state of FIG. 33 the volume of the second chamber 629 is minimum and the volume of the first chamber 628 is maximum, completing the suction and discharge operations.

Figure 41:
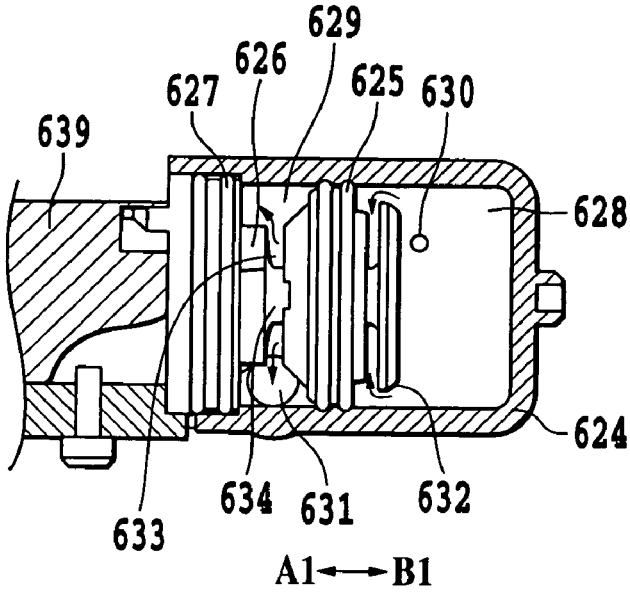
FIG. 41 is a cross-sectional view when the piston shaft of FIG. 33 moves toward a top dead point.
Figure 42:
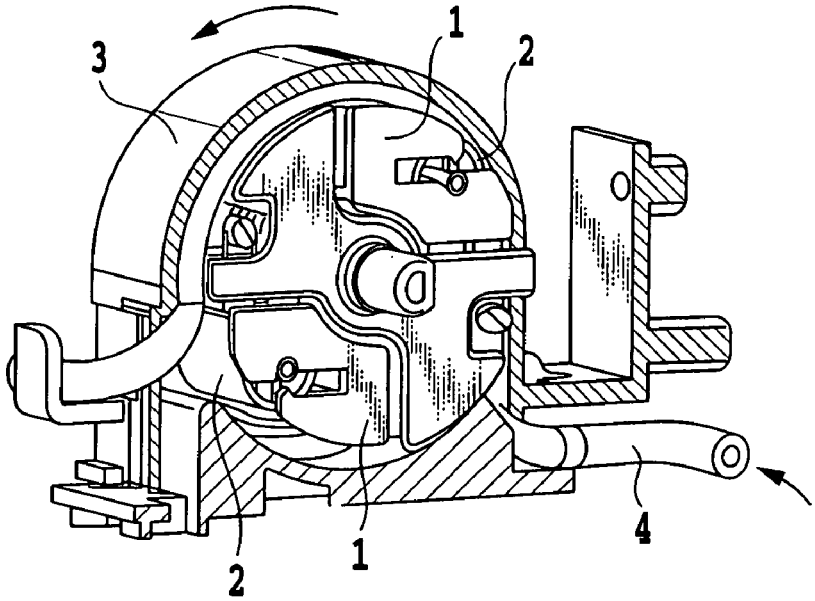
FIG. 42 is a partly cutaway perspective view showing a construction of a conventional tube pump.
Figure 43:
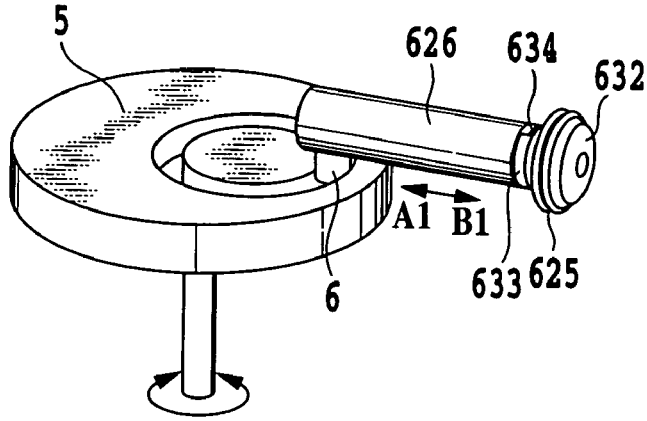
FIG. 43 is a perspective view showing an example of a motion conversion mechanism in the conventional piston pump.
Figure 44:
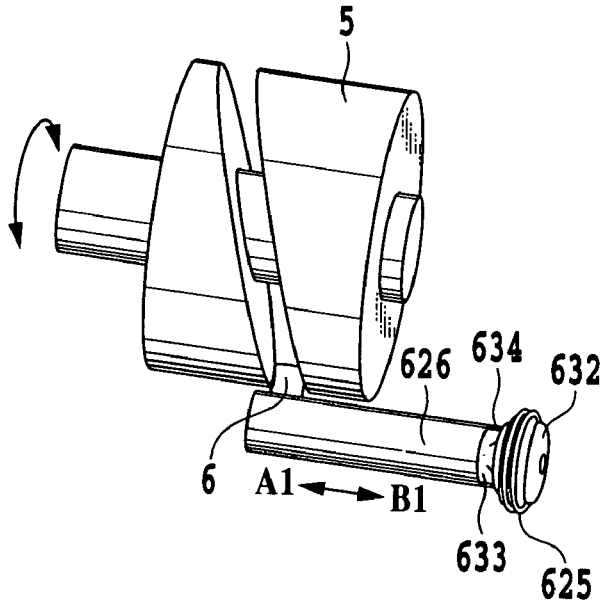
FIG. 44 is a perspective view showing another example of the motion conversion mechanism in the conventional piston pump.
Figure 45:
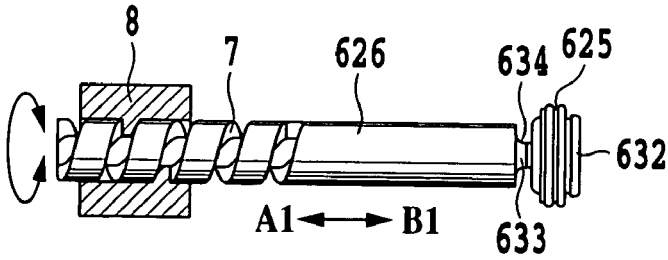
FIG. 45 is a perspective view showing still another example of the motion conversion mechanism in the conventional piston pump.

FIG. 41 is a cross-section showing a state in which the piston shaft 626 has moved slightly from the bottom dead point of FIG. 33 in the direction of arrow B1.

When the piston shaft 626 moves in the direction B1, the piston 625 does not immediately move due to friction between it and the inner circumference of the cylinder 624 and comes into intimate contact with the piston stopper 634. As a result, the first chamber 628 and the second chamber 629 communicate with each other through the clearance between the outer circumference of the piston shaft 626 and the inner circumference of the piston 625 and through the communication grooves. In this state, as the piston shaft 626 moves further in the direction of arrow B1, the second chamber 629 is expanded producing a negative pressure and the first chamber 628 is compressed producing a positive pressure. A flow resistance of the suction port 630 is set higher than a flow resistance of a space ranging from the clearance between the outer circumference of the piston shaft 626 and the inner circumference of the piston 625 to the communication grooves. Thus, a pressure difference between the first chamber 628 and the second chamber 629 causes the sucked ink in the first chamber 628 to flow into the second chamber 629 from the clearance between the outer circumference of the piston shaft 626 and the inner circumference of the piston 625 through the communication grooves.

As described above, the reciprocal motion of the piston shaft 626 in the directions of arrows A1, B1 can suck ink from the suction port 630 into the first chamber 628 and cause the ink to flow from the first chamber 628 to the second chamber 629 for discharging from the discharge port 631.

(Other Embodiments)

The recovery operation to maintain the printing performance of the print head is not limited to the capping of the print head, the suction-based recovery operation that sucks out ink not contributing to image printing from nozzles of the print head and the wiping of the print head Other recovery operations include, for example, a pressurized recovery operation that pressurizes ink in the print head to discharge ink not contributing to image printing from the nozzles and a preliminary ejection that causes the print head to eject ink not contributing to image printing from the nozzles. When the pressurized recovery operation is to be performed, a pump unit for producing a positive pressure may be used in place of or in combination with the existing suction pump unit and the generated positive pressure may be applied to the interior of the print head.

To maintain the performance of the print head, the recovery unit 600 can perform a suction-based recovery operation that sucks out ink not contributing to image printing from nozzles of the print head, a wiping that wipes clean the nozzle face of the print head, a recovery operation that pressurizes ink in the print head to discharge ink not contributing to image printing from the nozzles, and a preliminary ejection that causes the print head to eject ink not contributing to image printing from the nozzles. The piston pump 640 can be used as a pressure source for supplying a pressure (positive or negative) used in these recovery operations.

The groove 626A and the boat-shaped piece 638 need only be provided at a position facing the circumferences of the piston shaft 626 and the control ring 637. In an arrangement contrary to the above embodiment, the groove 626A may be provided on the control ring 637 side and the boat-shaped piece 638 on the piston shaft 626 side. The piston shaft 626 can be reciprocally moved not only by rotating the control ring 637 in the direction of arrow b but also in the direction of arrow a.

The ink jet print head apparatus can use various types of print heads which, for example, employ electrothermal transducers or piezoelectric elements. When electrothermal transducers are used, bubbles are generated in ink by thermal energy they produce and the expanding pressure of the bubbles is used to eject ink droplets from the nozzles.

The present invention can be applied not only to a serial scan type printing apparatus but also to a full line type printing apparatus.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

What is claimed is:

1. A printing apparatus for printing an image on a print medium by using a print head, comprising:

transport means for transporting the print medium by a driving force of a first drive source;

feeding means for feeding the print medium to the transport means by a driving force of a second drive source; and recovery means for performing, by a first drive mechanism and a second drive mechanism, a recovery operation to maintain a printing performance of the print head, wherein the first drive mechanism uses the first drive source as its drive source and is operated through a clutch mechanism according to a direction in which a driving force of the first drive source is generated, the clutch mechanism being adapted to transmit a rotation in only one direction of the first drive source, and wherein the second drive mechanism uses the second drive source as its drive source, has a dead zone in which a rotational force is not transmitted to the feeding means when the second drive source changes its rotation direction, and is operated in the dead zone according to a direction in which a driving force of the second drive source is generated.

2. A printing apparatus according to claim 1, wherein the print head is an ink jet print head capable of ejecting ink from nozzles, and one of the first drive mechanism and the second drive mechanism is a pump mechanism to produce a pressure for discharging ink not contributing to image printing from nozzles of the ink jet print head.

3. A printing apparatus according to claim 2, wherein the pump mechanism produces a negative pressure to suck out ink not contributing to image printing from nozzles of the ink jet print head.

4. A printing apparatus according to claim 2, further comprising:

discharge means for discharging the print medium transported by the transport means;

wherein the transport means transports the print medium toward the discharge means by a driving force in one direction of the first drive source and transports the print medium from the discharge means toward the feeding means by a driving force in the other direction of the first drive source, and wherein the pump mechanism is the first drive mechanism and is not driven by the driving force in one direction of the first drive source and is driven by the driving force in the other direction of the first drive source.

5. A printing apparatus according to claim 2, wherein the pump mechanism comprises a piston pump having a piston adapted to move in a cylinder.

6. A printing apparatus according to claim 1, wherein the print head is an ink jet print head capable of ejecting ink from nozzles, and one of the first drive mechanism and the second drive mechanism is at least a capping mechanism for capping the ink jet print head or a wiping mechanism for wiping a nozzle-formed face of the ink jet print head.

7. A printing apparatus according to claim 1, wherein the second drive mechanism is started when a driving force of the second drive source changes its direction from one direction to the other direction, and the feeding means is not driven while the second drive mechanism is operating, feeds the print medium to the transport means by a driving force in one direction of the second drive source, and returns the print medium from the transport means by a driving force in the other direction of the second drive source.

8. A printing apparatus according to claim 7, wherein the feeding means has a dead zone in which it is not driven by a driving force of the second drive source from when the second drive mechanism starts until it completes the operation.

9. A printing apparatus according to claim 7, wherein, when the operation of the second drive mechanism is completed by a driving force in one direction of the second drive source, the second drive mechanism is not driven by a driving force in one direction subsequently produced by the second drive source.

10. A printing apparatus according to claim 9, further comprising:

a gear train for transmitting a driving force in one direction of the second drive source to the second drive mechanism; and a notched portion provided at one part of the gear train, the notched portion being adapted to interrupt a transmission of the driving force in one direction of the second drive source to the second drive mechanism when the operation of the second drive mechanism using the driving force in one direction of the second drive source is completed.

11. A printing apparatus according to claim 1, wherein the feeding means has a dead zone in which it is not driven immediately by a driving force of the second drive source, and the second drive mechanism is driven in the dead zone of the feeding means by driving forces in one direction and the other direction of the second drive source.

12. A printing apparatus according to claim 1, wherein the second drive mechanism has its operation amount limited based on a result of detection by a position detection means that detects a position of a moving part of the second drive mechanism.

13. A recovery device for performing a recovery operation on a print head to maintain a printing performance of the print head, the print head being adapted to print an image on a print medium, the recovery device comprising:

a first drive mechanism and a second drive mechanism for performing the recovery operation, wherein the first drive mechanism uses as its drive source a first drive source for driving a transport means to transport the print medium and is operated through a clutch mechanism according to a direction in which a driving force of the first drive source is generated, the clutch mechanism being adapted to transmit a rotation in only one direction of the first drive source, and wherein the second drive mechanism uses as its drive source a second drive source for driving a feeding means to feed the print medium to the transport means, has a dead zone in which a rotational force is not transmitted to the feeding means when the second drive source changes its rotation direction, and is operated in the dead zone according to a direction in which a driving force of the second drive source is generated.

14. A recovery method for performing a recovery operation on a print head to maintain a printing performance of the print head, the print head being adapted to print an image on a print medium, the recovery method comprising the steps of:

using a first drive mechanism and a second drive mechanism for performing the recovery operation, wherein the first drive mechanism uses as its drive source a first drive source for driving a transport means to transport the print medium and is operated through a clutch mechanism according to a direction in which a driving force of the first drive source is generated, the clutch mechanism being adapted to transmit a rotation in only one direction of the first drive source, and wherein the second drive mechanism uses as its drive source a second drive source for driving a feeding means to feed the print medium to the transport means, has a dead zone in which a rotational force is not transmitted to the feeding means when the second drive source changes its rotation direction, and is operated in the dead zone according to a direction in which a driving force of the second drive source is generated.

15. A piston pump for reciprocally driving a piston in a cylinder through a piston shaft by using a rotating force of a rotating body, wherein the piston shaft is kept from rotating about its own axis, wherein the rotating body is rotatable about the axis of the piston shaft, wherein one of facing parts of a circumference of the piston shaft and a circumference of the rotating body is formed with a continuous spiral groove that crosses at one part, and wherein the other of the facing parts is provided with a projection that fits in the groove so that it is movable relative to the groove, in order to convert a rotary motion in at least one direction of the rotating body into a linear reciprocal motion of the piston shaft.

16. A piston pump according to claim 15, wherein a boat-shaped piece rotatable about an axis almost perpendicular to the axis of the piston shaft is mounted on the rotating body at a fixed position, and the projection is provided to the boat-shaped piece.

17. A piston pump according to claim 15, further comprising:

a rotary driving body; and a clutch mechanism to transmit a rotating force in one direction of the rotary driving body to the rotating body.

18. A piston pump according to claim 17, wherein the clutch mechanism has a spring which is tightened by the rotation in one direction of the rotary driving body and transmits the rotating force and which is loosened by the rotation in the other direction of the rotary driving body and does not transmit the rotating force.

19. A piston pump according to claim 15, further comprising:

a rotary driving body; and a transmission mechanism to transmit a rotating force of the rotary driving body to the rotating body, wherein the transmission mechanism has a dead zone in which the rotating force of the rotary driving body is not transmitted to the rotating body until the rotary driving body rotates a predetermined distance after it has changed its rotating direction.

20. A printing apparatus for printing an image on a print medium by using a print head, comprising:

recovery means for performing a recovery operation to maintain a function of the print head by using an introduced pressure, wherein the piston pump as claimed in claim 15 is used as a source of the pressure used by the recovery means.

21. A printing apparatus according to claim 20, wherein the print head is an ink jet print head capable of ejecting ink from its nozzles, wherein the recovery means has a suction-based recovery function to suck out ink not contributing to image printing from the nozzles of the ink jet print head by using the introduced negative pressure, and wherein the piston pump generates the negative pressure used by the recovery means.

22. A printing apparatus according to claim 20, further comprising:

transport means for transporting the print medium by a rotating force of a transport roller, wherein the piston pump is driven by the rotating force of the transport roller.

23. A printing apparatus according to claim 22, wherein the transport roller transports the print medium from a printing operation position in a discharge direction.

24. A printing apparatus according to claim 22, wherein the piston shaft of the piston pump is arranged on a rotary axis of the transport roller.

25. A printing apparatus according to claim 20, wherein the print head is an ink jet print head capable of ejecting ink from its nozzles by using thermal energy generated by electrothermal transducers.

26. A recovery device for performing a recovery operation to maintain a function of a print head by using an introduced pressure, the recovery device having the piston pump as claimed in claim 15 as a source of the pressure used by the recovery operation.

27. A recovery device according to claim 26, wherein the print head is an ink jet print head capable of ejecting ink from its nozzles, wherein the recovery operation includes a suction-based recovery operation to suck out ink not contributing to image printing from the nozzles of the ink jet print head by using the introduced negative pressure, and wherein the piston pump generates a negative pressure used by the suction-based recovery operation.

* * * * *

UNITED STATES PATENT AND TRADEMARK OFFICE

CERTIFICATE OF CORRECTION

PATENT NO. : 7,097,272 B2
APPLICATION NO. : 10/765399
DATED : August 29, 2006
INVENTOR(S) : Yoshida et al.

It is certified that error appears in the above-identified patent and that said Letters Patent is hereby corrected as shown below:

COLUMN 1:
Line 15, “as” should read --as a--.

COLUMN 4:
Line 37, “constructions,” should read --constructions--.

COLUMN 10:
Line 21, “is” should be deleted.
Line 66, “rollers 202” should read --rollers 202,--.

COLUMN 13:
Line 28, “in knozzles” should read --ink nozzles--.

COLUMN 15:
Line 52, “CCW” should read --CCW.--.

COLUMN 17:
Line 52, “grooves” should read --grooves.--.

COLUMN 18:
Line 56, “operation” should read --operation.--.

COLUMN 19:
Line 13, “operation” should read --operation.--.

COLUMN 20:
Line 30, “mounted” should read --mounted.--.

UNITED STATES PATENT AND TRADEMARK OFFICE

CERTIFICATE OF CORRECTION

PATENT NO. : 7,097,272 B2
APPLICATION NO. : 10/765399
DATED : August 29, 2006
INVENTOR(S) : Yoshida et al.

It is certified that error appears in the above-identified patent and that said Letters Patent is hereby corrected as shown below:

COLUMN 21:
Line 4, "A1.B1." should read --A1, B1.--.

COLUMN 22:
Line 32, "head" should read --head.--.
Line 65, "head" should be deleted.

Signed and Sealed this

Seventeenth Day of June, 2008

JON W. DUDAS
*Director of the United States Patent and Trademark Office*